US005991593A

United States Patent [19]

Sugiyama

[11] Patent Number: 5,991,593

[45] Date of Patent: Nov. 23, 1999

[54] SHEET SUPPLYING APPARATUS OF AIR ABSORBING TYPE

[75] Inventor: Hiroshi Sugiyama, Mishima, Japan

[73] Assignee: Canon Kabushiki Kaisha, Tokyo, Japan

[21] Appl. No.: 08/921,381

[22] Filed: Aug. 29, 1997

[30] Foreign Application Priority Data

| | | | |
|---|---|---|---|
| Sep. 4, 1996 | [JP] | Japan | 8-233848 |
| Nov. 28, 1996 | [JP] | Japan | 8-318235 |
| Dec. 25, 1996 | [JP] | Japan | 8-345895 |

[51] Int. Cl.[6] ..... B65H 3/08; G03G 15/00

[52] U.S. Cl. ..... 399/388; 271/11; 271/145; 399/393

[58] Field of Search ..... 399/75, 388, 393, 399/361; 271/3.07, 3.11, 5, 11, 90, 96, 99, 102, 106, 108, 145, 165; 414/797, 797.4

[56] References Cited

U.S. PATENT DOCUMENTS

| | | | |
|---|---|---|---|
| 4,155,546 | 5/1979 | Jacobs | 271/11 |
| 4,248,417 | 2/1981 | Fujimoto | 271/106 X |
| 4,299,380 | 11/1981 | Ogihara et al. | 271/11 X |
| 4,420,150 | 12/1983 | Umezawa | 271/11 |
| 4,589,648 | 5/1986 | Hancock | 271/106 |
| 4,591,140 | 5/1986 | Illig et al. | 271/11 |
| 4,968,019 | 11/1990 | Tanabe et al. | 271/106 |
| 5,026,039 | 6/1991 | Kuzuya et al. | 271/11 |

FOREIGN PATENT DOCUMENTS

| | | |
|---|---|---|
| 485 748 | 2/1918 | France . |
| 26 10 480 | 9/1976 | Germany . |
| 34 04 215 | 8/1985 | Germany . |
| 255719 | 2/1949 | Switzerland . |
| 674842 | 7/1952 | United Kingdom . |

OTHER PUBLICATIONS

Patent Abstracts of Japan, vol. 006, No. 240 (M–174), Nov. 27, 1982 & JP 57 137236 A (Nissan Jidosha KK), Aug. 24, 1982.

*Primary Examiner*—William Royer
*Assistant Examiner*—Sophia S. Chen
*Attorney, Agent, or Firm*—Fitzpatrick, Cella, Harper & Scinto

[57] ABSTRACT

The present invention provides a sheet supplying apparatus which has a sheet supporting device for supporting a sheet, a sheet absorbing device for absorbing the sheet supported by the sheet supporting device by utilizing an absorbing force generated by an absorbing force generating device, and a shift device for shifting the sheet absorbing device to bring the sheet absorbed by the sheet absorbing device to a sheet supply device disposed downstream in a sheet supplying direction. The sheet absorbing device and the shift device receive respective driving forces from the single or common drive source.

15 Claims, 31 Drawing Sheets

SHEET SUPPLYING APPARATUS OF AIR ABSORBING TYPE

BACKGROUND OF THE INVENTION

1. Field of the Invention

The present invention relates to a sheet supplying apparatus used with an image forming apparatus such as a printer, a copying machine and the like, and more particularly, it relates to a sheet supplying apparatus in which stacked sheets are separated and supplied one by one by absorbing the sheet.

2. Related Background Art

Conventionally, as one of sheet supplying apparatuses used with an image forming apparatus such as a printer, a copying machine and the like, there has been proposed a sheet supplying apparatus of air absorption type in which sheets stacked on a sheet stacking means are separated and supplied one by one by absorbing the sheet (for example, see Japanese Patent Application Laid-open No. 61-23050). Such a sheet supplying apparatus comprises a sheet absorbing means for absorbing a sheet from a sheet stack rested on a sheet stacking means by utilizing an absorbing force generated by an absorbing force generating means, and a shift means for shifting the sheet absorbing means to direct the sheet absorbed by the sheet absorbing means to a sheet supply means disposed downstream of the sheet stacking means in a sheet supplying direction, and the separated sheet is supplied to a recording portion by the sheet supply means.

The absorbing force generating means is generally constituted by a relatively large negative pressure generating pump having an exclusive motor. After the sheet is absorbed by the sheet absorbing means connected to the negative pressure generating pump and the sheet is transferred to the sheet supply means, an absorbing force is not needed until a next sheet is to be absorbed. Thus, since the absorbing force of the sheet absorbing means affects a bad influence upon the transferring of the sheet to the sheet supplying means, it is controlled such that the absorbing force acting on the sleet absorbing means is reduced to substantially zero by communicating the absorbing force to the atmosphere in an air path between the negative pressure generating pump and the sheet absorbing means. Further, since the negative force generated by the absorbing force generating means or absorbing capacity is influenced by permeability of the sheet to be absorbed, for example, when a sheet such as a plain sheet having relatively great permeability is used, the negative pressure generated by the negative pressure generating pump is set so that a desired absorbing force can be obtained in accordance with the permeability of the sheet.

However, in the above-mentioned conventional technique, since the absorbing force generating means is constituted by the relatively large negative pressure generating pump having the exclusive motor, the entire apparatus is made bulky not to save space, and, since a plurality of independent drive sources are provided, the number of parts is increased to make the apparatus expensive. Further, since the plurality of independent drive sources must be controlled in a synchronous manner, the construction of the control means for bringing the absorbing force of the sheet absorbing means to substantially zero (after the sheet is absorbed by the sheet absorbing means and then is transferred to the downstream sheet supply means) becomes complicated. In addition, when the negative pressure generated by the negative pressure generating pump or the absorbing capacity is set in dependence upon the sheet having relatively great permeability, if a sheet such as a resin film sheet having relatively small permeability is used, the absorbing force of the sheet absorbing means excessively acts on the sheet, so that sheet is deformed and/or excessive load is added to the sheet absorbing means and the negative pressure generating pump to damage the latter and to spend useless energy.

SUMMARY OF THE INVENTION

The present invention aims to eliminate the above-mentioned conventional drawbacks, and has an object to provide a sheet supplying apparatus and an image forming apparatus having such a sheet supplying apparatus, in which the number of parts is reduced to make the apparatus compact and cheaper, an absorbing force of a sheet absorbing means can easily be controlled, and a value of the absorbing force can easily be adjusted.

To achieve the above object, accord ing to the present invention, there is provided a sheet supplying apparatus comprising a sheet supporting means for supporting a sheet, a sheet absorbing means for absorbing the sheet supported by the sheet supporting means by utilizing an absorbing force generated by an absorbing force generating means, and a shift means for shifting the sheet absorbing means to bring the sheet absorbed by the sheet absorbing means to a sheet supply means disposed downstream in a sheet supplying direction. Wherein the sheet absorbing means and the shift means receive respective driving forces from the same drive source.

DETAILED DESCRIPTION OF THE PREFERRED EMBODIMENTS

Now, a sheet supplying apparatus according to a preferred embodiment of the present invention and a copying machine as an image forming apparatus having such a sheet supplying apparatus will be fully explained with reference to the accompanying drawings.

Figure 1:
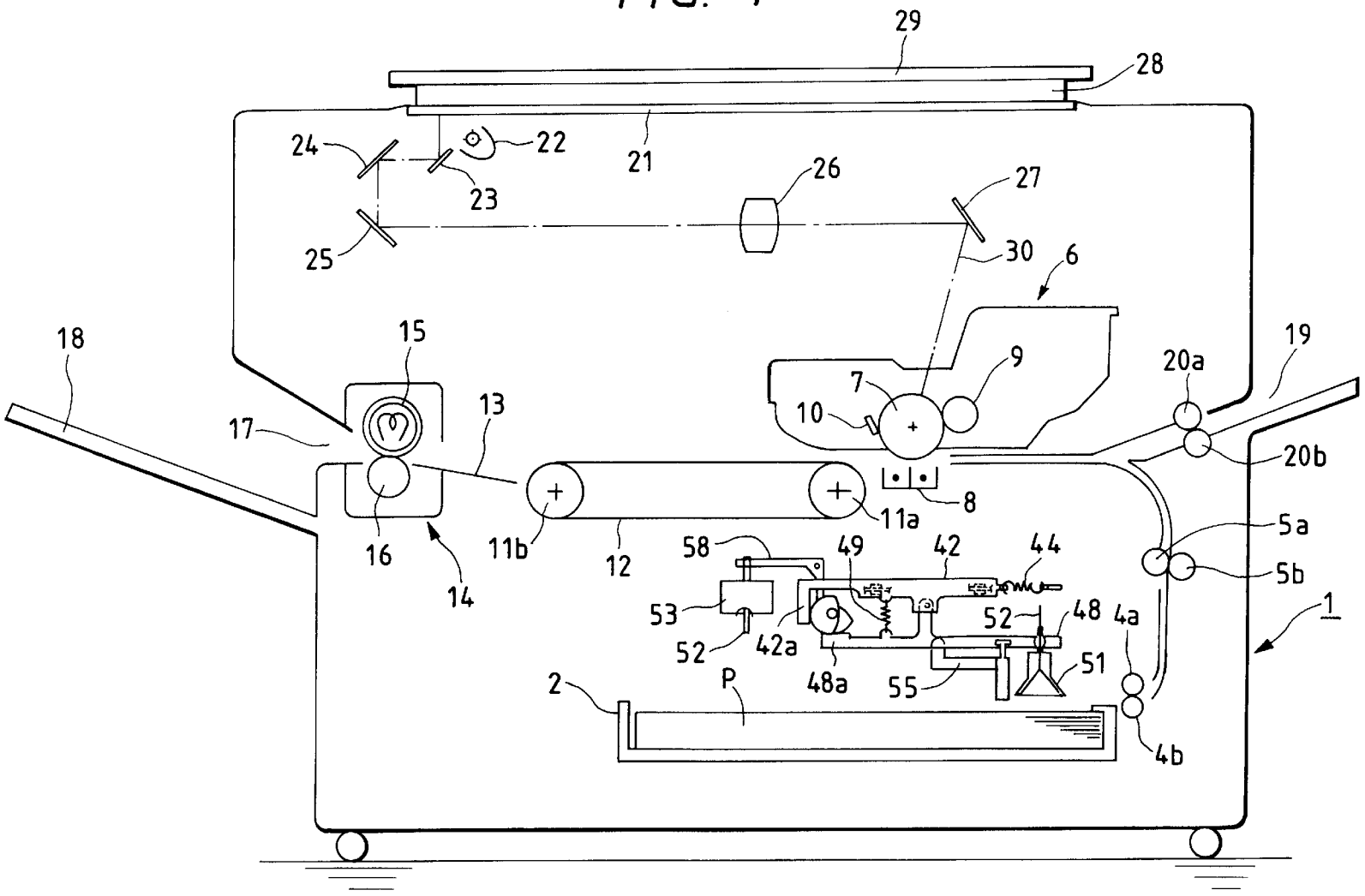
FIG. 1 is an elevational sectional view of an image forming apparatus having a sheet supplying apparatus according to the present invention.

First of all, an entire construction of the copying machine (image forming apparatus) having the sheet supplying apparatus according to the preferred embodiment of the present invention will be described with reference to FIG. 1. In FIG. 1, a sheet cassette (sheet stacking means) 2 containing sheets P formed from paper or resin film therein is disposed at a lower portion of the copying machine 1, and the sheets P stacked in the sheet cassette 2 are absorbed and picked up one by one by absorb pads (sheet absorbing means) 51 disposed above the sheet cassette 2. Only an uppermost sheet P' (among the sheets P) having front corners caught by separation pawls 2*a* disposed on the sheet cassette 2 at a downstream end thereof in a sheet supplying direction is separated, and the separated sheet P' is sent to a pair of sheet supply rollers (sheet supply means) 4*a*, 4*b* (see FIG. 6).

The pair of sheet supply rollers 4*a*, 4*b* are rotatably supported by a main frame 41 of the copying machine 1 and are biased toward each other by a biasing means, and are rotated by a driving force from a drive source so that the sheet is supplied through a nip between the rollers 4*a* and 4*b*. The sheet P supplied by the pair of sheet supply rollers 4*a*, 4*b* is sent to a pair of regist rollers 5*a*, 5*b*, where the skew-feed of the sheet is corrected. In synchronous with rotation of an electrophotographic photosensitive drum 7 provided in a process cartridge (image forming means) 6 disposed downstream in the sheet supplying direction (referred to merely as "downstream side" hereinafter), the sheet is sent between the photosensitive drum 7 and a transfer charger 8 opposed to the drum, to thereby form an image on the sheet.

The process cartridge 6 includes therein the above-mentioned photosensitive drum 7 on which a latent image is formed by illuminating or exposing image information light onto a charged surface of the drum, a developing sleeve 9 for developing the latent image formed on the photosensitive drum 7 as a toner image, and a cleaning blade 10 for removing residual toner remaining on the photosensitive drum 7 after the toner image formed on the photosensitive drum 7 is transferred onto the sheet P by the transfer charger 8. An agitating mechanism and a waste toner container (both are not shown) are also included in the process cartridge.

Downstream of the process cartridge 6, there is disposed a convey belt 12 mounted around rollers 11*a* and 11*b*, and appropriate tension is applied to the convey belt by a tensioner provided on the roller 11*b*. By rotating the roller 11*b* by a drive means, the convey belt 12 is rotated to pass between the photosensitive drum 7 and the transfer charger 8 while bearing the sheet P thereon to further convey the sheet in a downstream direction.

The sheet P conveyed by the convey belt 12 is directed to a fixing device 14 by a pre-fixing guide 13. The fixing device 14 comprises a heat roller 15 having a heater therein, and a pressure roller 16 opposed to the heat roller. The pressure roller 16 is urged against the heat roller 15 by a spring. While the sheet P is being passed through a nip between the rollers 15 and 16, heat and pressure are applied to the sheet, to thereby fix the toner image on the sheet P.

The sheet P on which the toner image was fixed by the fixing device 14 is discharged through a discharge opening 17 and is rested on a discharge tray 18 with the imaged surface facing upwardly (face-up). A manual insertion sheet supply opening 19 is used when thick sheets or thin sheets which are hard to be supplied from the sheet cassette 2 are used. A sheet P supplied through the manual insertion sheet supply opening 19 is supplied by a pair of sheet supply rollers 20*a*, 20*b* to be sent between the photosensitive drum 7 and the transfer charger 8. In this way, an image is formed on the sheet in the same manner as described above.

An image reading means for reading image information on an original is disposed at an upper portion of the copying machine. The image reading means comprises an original glass plate 21 on which an original is rested with the imaged surface thereof facing downwardly, and an optical system disposed below the original glass plate 21 and movable along the original glass plate 21 in a left-right direction in FIG. 1 and including an illumination lamp 22, mirrors 23, 24 and 25, a focusing lens 26 and a mirror 27. A pressure plate 29 openable with respect to the copying machine 1 and including an urging sheet 28 formed from a sponge member having hardness suitable for moderately urging the original from the above is disposed on the original glass plate 21.

The original is rested on the original glass plate 21 with the imaged surface thereof facing downwardly and the original is urged against the glass plate by the pressure plate 29 to closely contact the original with the original glass plate 21. When a start button is depressed, the illumination lamp 22, mirrors 23 to 25 and focusing lens 26 are shifted from left to right in FIG. 1. Light emitted from the illumination lamp 22 is reflected by the original, and reflected light 30 including image information is reflected by the mirrors 23 to 25 to pass through the focusing lens 26. Then, the light is reflected by the mirror 27 to expose the surface of the photosensitive drum 7 to thereby form a latent image corresponding to the image information on the photosensitive drum. Thereafter, the toner image is formed on the sheet P in the manner as mentioned above.

Next, the sheet supplying apparatus according to the present invention will be explained with reference to FIGS. 2 to 6. In the illustrated embodiment, an example of a sheet supplying apparatus of upside sheet supply type in which the sheets P contained in the sheet cassette (sheet stacking means) 2 are successively supplied one by one from the uppermost sheet is shown.

Figure 2:
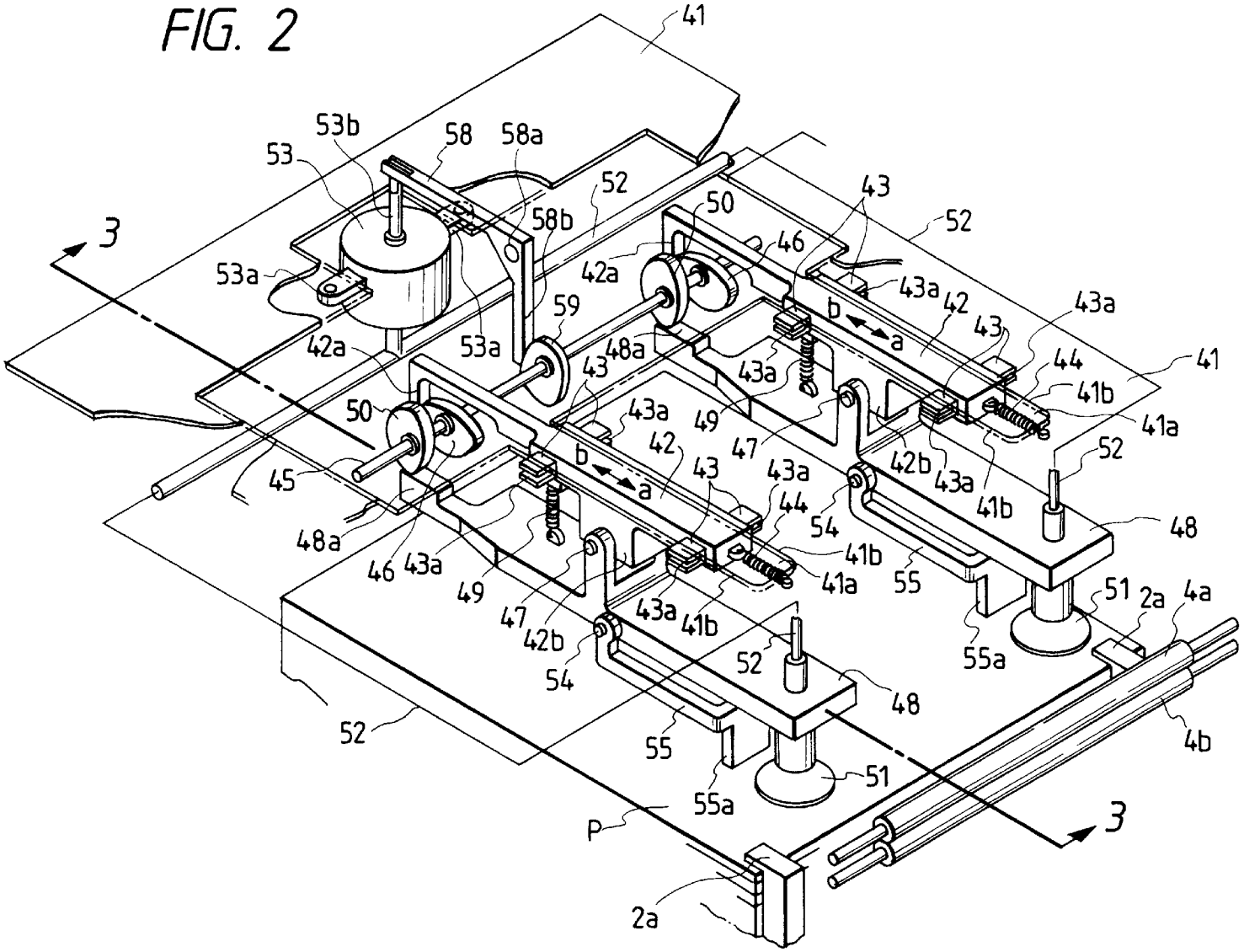
FIG. 2 is a perspective view of the sheet supplying apparatus.

In FIG. 2, a pair of notches 41*a* each having predetermined length and width are formed in the main frame 41 of the copying machine 1 above the sheet cassette 2 at positions situated inwardly of lateral edges of the sheet P contained in the sheet cassette 2 by a predetermined distance. A pair of movable members 42 each having a width corresponding to the width of the notch 41*a* are received in the corresponding notches 41*a* for sliding movement in directions a, b along the notches 41*a*. More specifically, grooves 43*a* of four brackets 43 secured to lateral edges of each movable member 42 at predetermined positions are slidably fitted on lateral edges 41*b* of the corresponding notch 41*a*. Tension coil springs 44 are disposed between portions of the main frame 41 downstream of the notches 41*a* and downstream ends of the movable members 42, so that the pair of movable members 42 are always biased toward the direction a in FIG. 2 by the pulling forces of the tension coil springs 44.

On the other hand, cam abutment portions 42*a* extending downwardly in perpendicular to a longitudinal direction of the movable member 42 are integrally formed on upstream ends of the movable members 42. The cam abutment portions 42*a* abut against a pair of cams 46 secured to a rotation drive shaft 45 rotatably supported by the main frame 41, so that the movable members 42 can be shifted in the directions a, b in FIG. 2 in accordance with the rotation of the cams. The pair of movable members 42 and the pair of cams 46 constitute a shift means for shifting a pair of absorb pads 51 as a sheet absorbing means (to be described later) to direct the sheet P absorbed by the absorb pads 51 to the pair of sheet supply rollers (sheet supply means) 4*a*, 4*b*.

Figure 3:
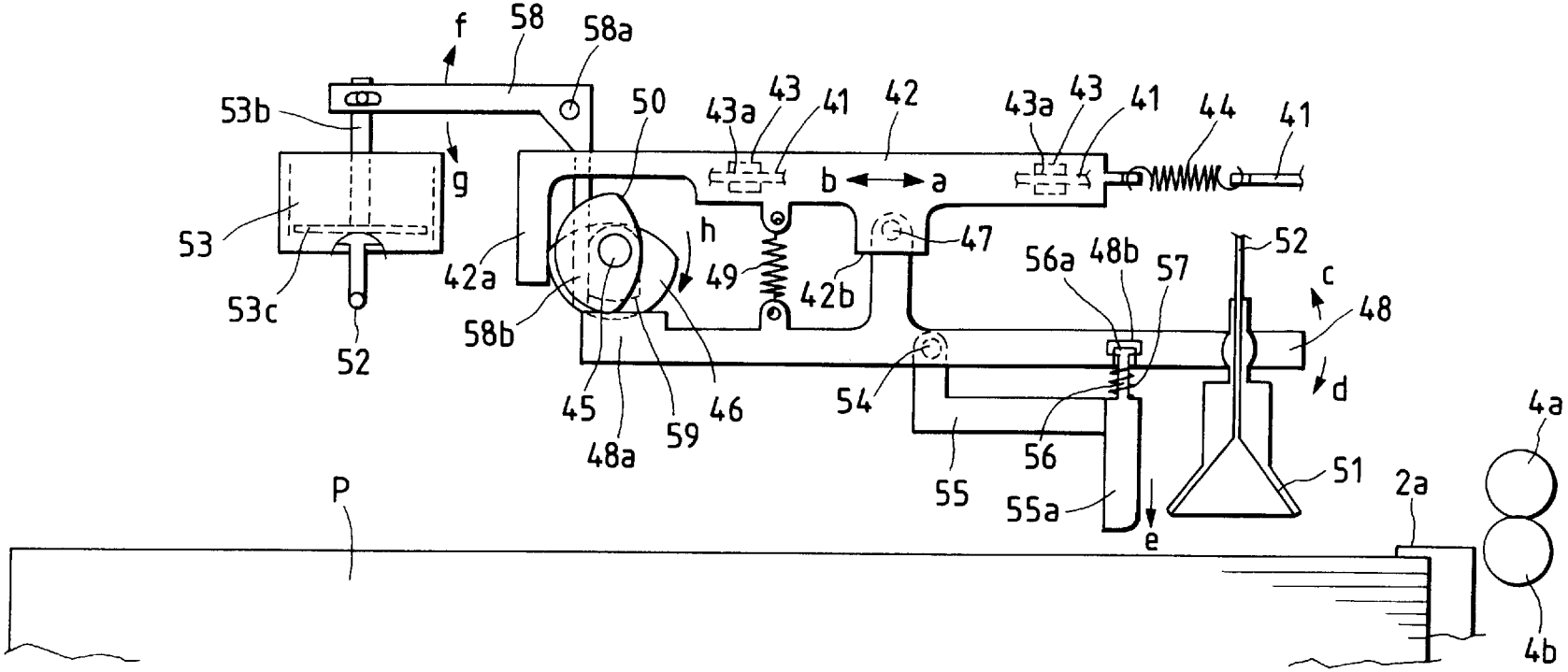
FIGS. 3, 4, 5 and 6 are sectional views taken along the line 3—3 in FIG. 2, showing sheet supplying conditions.

Each movable member 42 has a support portion 42*b* protruded downwardly from a central portion of the movable member between the brackets 43, and a pivot arm 48 is supported on a support shaft 47 provided on the support portion 42*b* for pivotal movement in directions c, d in FIG. 3. A tension coil spring 49 is disposed between the respective movable member 42 and the corresponding pivot arm 48 upstream of the support shaft 47 and downstream of the rotation drive shaft 45 in the sheet supplying direction, so that the pivot arm 48 is always biased toward the direction d in FIG. 3 by the pulling force of the tension coil spring 49.

On the other hand, cam abutment portions 48*a* are integrally formed with upstream ends of the pair of pivot arms 48. The cam abutment portions 48*a* abut against a pair of cams 50 secured to the rotation drive shaft 45 to rotate therewith, so that the pivot arms 48 can be rocked in the directions c, d in FIG. 3 in accordance with the rotation of the cams. The pair of absorb pads 51 are provided on downstream ends of the pair of pivot arms 48. Thus, when the pair of pivot arms 48 are rocked around their support shafts 47 by the rotation of the pair of cams 50, the absorb pads 51 attached to the ends of the respective pivot arms 48 are rocked in the directions c, d in FIG. 3 around the support shafts 47 within a predetermined range.

The absorb pads 51 are made of rubber and are connected, via tubes 52, to a suction pump (absorbing force generating means) 53 secured to the main frame 41. By sucking air from the interior of the absorb pads 51 by the suction pump 53 through the tubes 52 to generate negative pressure in the absorb pads, the sheet having a predetermined size and contained in the sheet cassette 2 can be absorbed by the absorb pads.

A pair of sheet holders (sheet hold-down means) 55 are rotatably (with respect to the pivot arms 48) supported on support shafts 54 provided on the respective pivot arms 48 downstream of the support shafts 47 in proximity thereto and upstream of the absorb pads 51 of the pivot arms 48. Each sheet holder 55 has a crank shape having a sheet abutment portion 55*a* for regulating the sheet P by abutting against the sheet stack P rested on the sheet cassette 2. The sheet abutment portion 55*a* has an upper stopper 56 having an upper end 56*a* retained in a groove 48*b* formed in the corresponding pivot arm 48, and a compression spring 57 is disposed around the stopper between an upper surface of the sheet abutment portion 55*a* and a lower surface of the pivot arm 48. The pair of sheet holders 55 are always biased toward a direction e in FIG. 3 (to rock around the support shafts 47 with respect to the pivot arms 48) by the biasing forces of the compression springs 57 and are set at predetermined positions by the stoppers 56.

The suction pump 53 is secured to the main frame 41 by brackets 53*a*. A partition wall 53*c* for changing internal volume of the suction pump 53 is reciprocally shifted within the suction pump so that, during the upward stroke of the partition wall 53*c*, negative pressure is generated in a lower negative pressure chamber of the suction pump, to thereby generate the negative pressure in the absorb pads 51 through the tubes 52. A movable rod 53*b* secured to the partition wall 53*c* is connected to one end of a link member 58 rotatably supported by the main frame 41 via a fulcrum 58*a*, and the other end of the link member 58 is provided with a cam abutment portion 58*b*. The cam abutment portion 58*b* abuts against a cam 59 secured to the rotation drive shaft 45 to rotate therewith, so that the link member 58 is rotated around the fulcrum 58*a* in directions f, g in FIG. 3 to reciprocally shift the partition wall 53*c* within the suction pump 53 via the movable rod 53*b* to change the internal volume of the suction pump 53, to thereby generate the negative pressure during the upward stroke of the partition wall 53*c*.

The rotation drive shaft 45 is connected to a drive source to be rotated thereby so that the cams 46, 50, 59 are simultaneously rotated in a direction h in FIG. 3. The pair of cams 46 can shift the pair of movable members 42 in the directions a, b in FIG. 3, the pair of cams 50 can shift the pair of pivot arms 48 in the directions c, d in FIG. 3, and the cam 59 can drive the suction pump 53 via the link member 58.

As shown in FIG. 3, regarding the cams 46, 50, 59 integrally secured to the rotation drive shaft 45, maximum lifts of the cams 50 are offset from maximum lifts of the cams 46 by about 90 degrees in the direction h in FIG. 3, and a maximum lift of the cam 59 has the same angular phase (is disposed at the same angular position) as the maximum lifts of the cams 46. The cams 46, 50 have high lift (large diameter) portions extending through about 180 degrees and low lift (small diameter) portions smoothly connected to the corresponding high lift portions, and the cam 59 has a high lift portion extending in one direction and having a predetermined width.

With the arrangement as mentioned above, the movable members (shift means) 42 and the suction pump (absorbing force generating means) 53 are subjected to driving forces from the common drive source via the rotation drive shaft 45, and the movable members 42 and the suction pump 53 are operated in a synchronous manner.

In the illustrated embodiment, the absorb pads 51, pivot arms 48, sheet holders 55 and movable members 42 are arranged in pair spaced apart from by a predetermined distance to handle a sheet P having a relatively great width. Now, an operation of the sheet supplying apparatus having the above-mentioned construction will be explained with reference to FIGS. 3 to 6.

FIG. 3 shows a waiting condition before the sheet P is supplied. In this condition, start ends of the high lift portions of the cams 46 abut against the cam abutment portions 42*a* of the movable members 42. Thus, the movable members 42 are maintained at left (FIG. 3) limit ends of their strokes in opposition to the biasing forces of the tension coil springs 44, and the absorb pads 51 are spaced apart from the upper surface of the sheet stack P contained in the sheet cassette 2 by a predetermined distance.

In this case, finish ends of the high lift portions of the cams 50 abut against the cam abutment portions 48*a* of the pivot arms 48 to lift the pivot arms 48 upwardly in the direction c in FIG. 3 in opposition to the biasing forces of the tension coil springs 49 to maintain the pivot arms 48 substantially horizontally, and the absorb pads 51 are spaced apart from the sheet stack P contained in the sheet cassette 2.

Further in this case, the sheet holders 55 are biased toward the direction e in FIG. 3 by the compression springs 57 but are held at predetermined positions by the stoppers 56 to be spaced apart from the sheet stack P contained in the sheet cassette 2. The low lift portion of the cam 59 abuts against the cam abutment portion 58*b* of the link member 58, so that the movable rod 53*b* of the suction pump 53 is stopped at a lowered position (before lifted in the direction f in FIG. 3). Thus, in this case, the negative pressure is not generated by the suction pump 53.

When the copy start button is depressed, the rotation drive shaft 45 is rotated in the direction h in FIG. 3 by the rotational driving force from the drive source, so that the cams 46, 50, 59 integrally secured to the rotation drive shaft 45 are also rotated in the direction h in FIG. 3.

The high lift portions of the cams 46 continue to slidingly contact with the cam abutment portions 42*a* of the movable members 42 to maintain the movable members 42 at their left limit ends until the rotation drive shaft 45 is rotated by about 180 degrees. On the other hand, the lift portions of the cams 50 which abut against the cam abutment portions 48*a* of the pivot arms 48 are gradually transferred from the high lift portions to the low lift portions, to thereby rock the pivot arms 48 around the support shafts 47 in the direction d in FIG. 4 by the biasing forces of the tension coil springs 49. As a result, the absorb pads 51 are lowered to be urged against the sheet stack P contained in the sheet cassette 2.

In this case, the sheet abutment portions 55*a* of the sheet holders 55 are also urged against the sheet stack P contained in the sheet cassette 2 (with predetermined pressure given by the compression springs 57) upstream of the absorb pads 51. Further, since the high lift portion of the cam 59 slidingly contacts with the cam abutment portion 58*b* of the link member 58, the link member 58 is rotated around the fulcrum 58*a* in the direction f in FIG. 4, so that the movable rod 53*b* connected to the end of the link member 58 is lifted to generate the negative pressure in the suction pump 53. Consequently, the negative pressure is generated in the absorb pads 51 connected to the suction pump 53 via the tubes 52, to thereby absorb the sheet P by the absorb pads 51.

Figure 4:
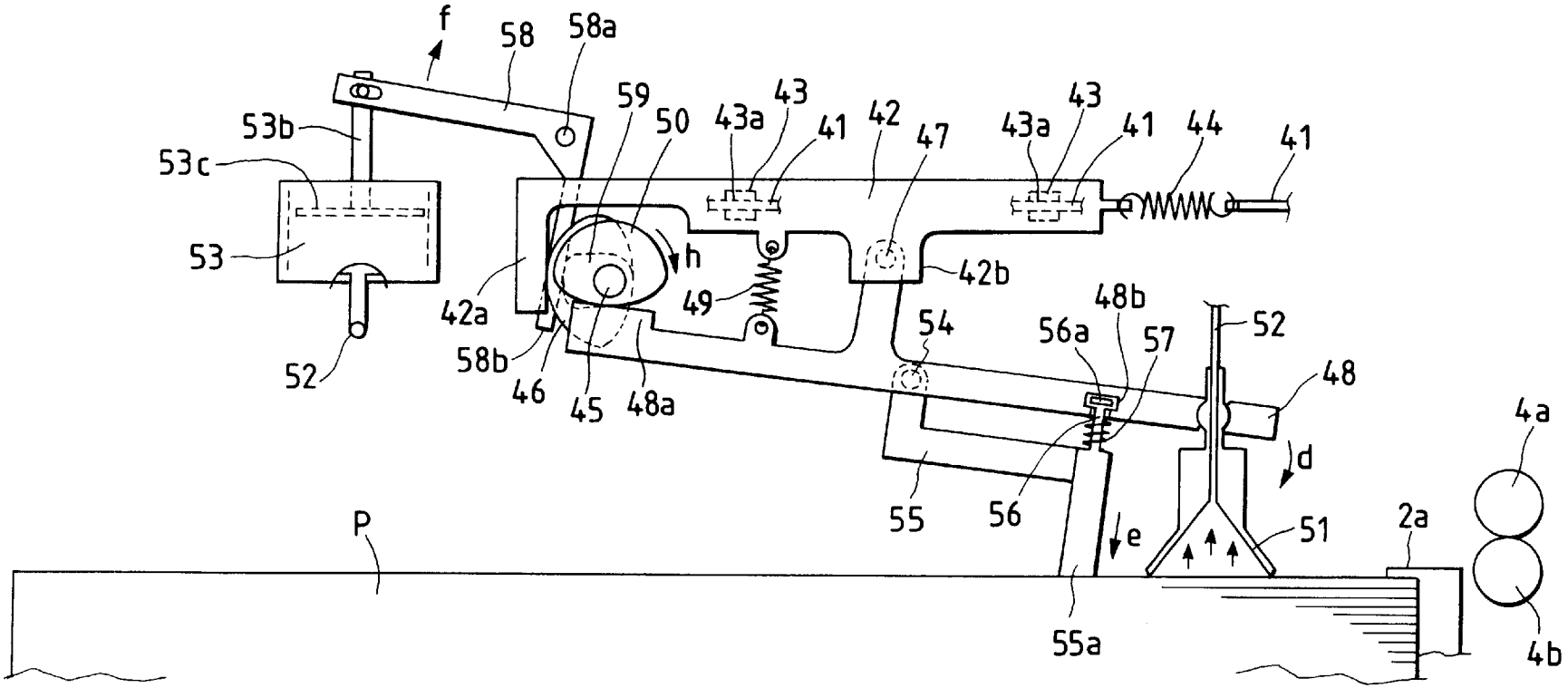
Figure 5:
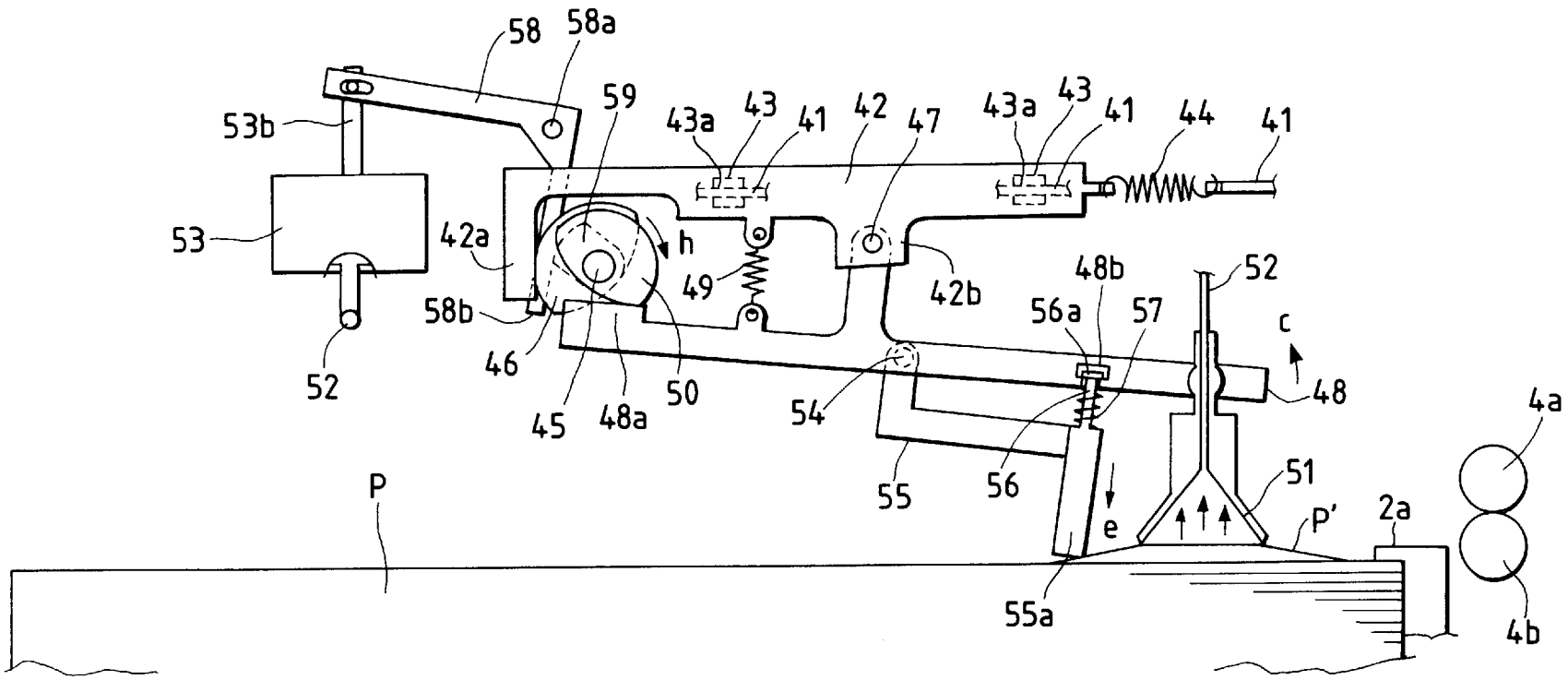

When the rotation drive shaft 45 is further rotated in the direction h in FIG. 4, as shown in FIG. 5, transient lift portions (having intermediate radii) of the cams 50 (which smoothly extend from the low lift portions to the start ends of the high lift portions) slidingly contact with the cam abutment portions 48*a* of the pivot arms 48 to slightly rotate the pivot arms 48 around the support shafts 47 in the direction c in FIG. 5, to thereby separate the absorb pads 51 from the uppermost sheet P' (regulated by the separation pawls 2*a*) of the sheet stack P contained in the sheet cassette 2.

In this case, since the high lift portions of the cams 46, 59 slidingly contact with the cam abutment portions 42*a* of the movable members 42 and the cam abutment portion 58*b* of the link member 58, respectively, the previous conditions are maintained. On the other hand, the sheet abutment portions 55*a* of the sheet holders 55 are still urged toward the direction e in FIG. 5 by the biasing forces of the compression springs 57 to still regulate the sheet stack P. When the front corners of the uppermost sheet P' absorbed and lifted by the absorb pads 51 ride over the separation pawls 2*a*, the uppermost sheet is released from the separation pawls.

The absorbing force acting on the uppermost sheet P' from the absorb pads 51 is greater than the absorbing force acting on the other underlying sheets from the absorb pads. Thus, in the sheet stack P regulated by the separation pawls 2*a* and held down by the sheet holders 55, the absorbing force of the absorb pads 51 acting on the uppermost sheet P' overcomes the resiliency of the uppermost sheet to ride the front corners of the uppermost sheet over the separation pawls 2*a*. Whereas, the absorbing force acting on the other sheets cannot overcome the resiliency of the sheet, so that the other sheets are still regulated by the separation pawls 2*a*. In this way, the uppermost sheet P' is separated from the other underlying sheets P.

Figure 6:
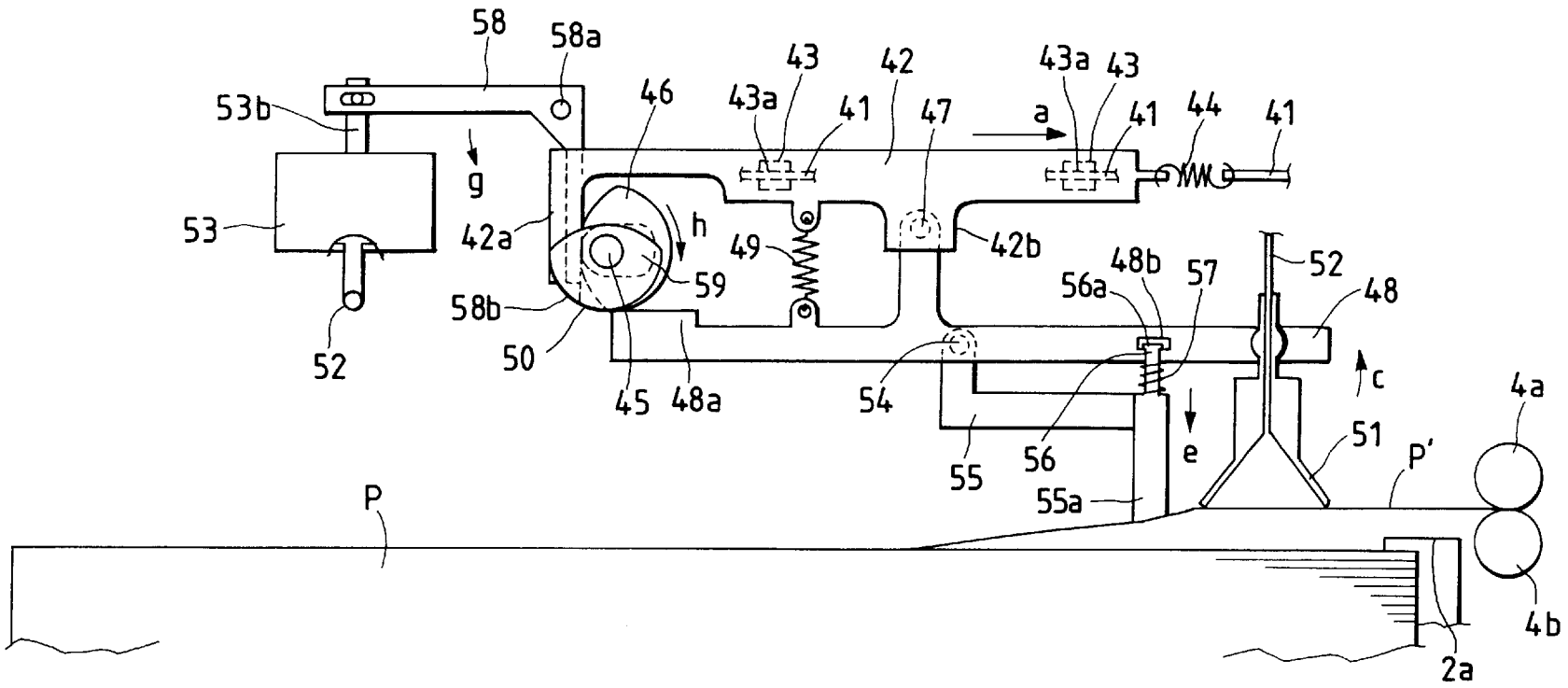

When the rotation drive shaft 45 is further rotated in the direction h in FIG. 5, as shown in FIG. 6, the high lift portions of the cams 50 slidingly contact with the cam abutment portions 48*a* of the pivot arms 48 to rotate the pivot arms 48 in the direction c in FIG. 6, to thereby lift the absorb pads 51. The pivot arms 48 are held substantially horizontally. In this case, the sheet holders 55 are lifted together with the pivot arms 48 to separate the sheet abutment portions 55*a* from the other sheets P contained in the sheet cassette 2. In this condition, the sheet abutment portions 55*a* are still biased toward the direction e in FIG. 6 by the biasing forces of the compression springs 57, but are held at the predetermined position by the stoppers 56. In this case, although the uppermost sheet P' lifted by the absorb pads 51 may be contacted with the sheet abutment portions 55*a*, since the urging force of the sheet abutment portions does not act on the uppermost sheet, friction between the uppermost sheet and the sheet abutment portions is very small not to disturb the supplying of the sheet P'.

Further in this case, as shown in FIG. 6, the lift portions of the cams 46 which abut against the cam abutment portions 42*a* of the movable members 42 are transferred from the high lift portions to the low lift portions, to thereby shift the pair of movable members 42 in the direction a in FIG. 6 along the respective notches 41*a* by the biasing forces of the tension coil springs 44, so that the pivot arms 48 held horizontally are shifted together with the movable members 42 in the direction a in FIG. 6, to thereby introduce a tip end of the uppermost sheet P' absorbed by the absorb pads 51 into the nip between the pair of sheet supply rollers 4*a* and 4*b*. In this way, the uppermost sheet is supplied by the rollers 4*a*, 4*b*.

Further in this case, the lift portion of the cam 59 which abuts against the cam abutment portion 58*b* of the link member 58 is transferred from the high lift portion to the low lift portion, to thereby rotate the link member 58 around the fulcrum 58*a* in the direction g in FIG. 6. As a result, the movable rod 53*b* connected to the link member 58 is lowered to restore the suction pump 53 in the non-negative pressure generating condition. When the movable rod 53*b* is lowered, positive pressure is prevented from being generated in the suction pump by a valve mechanism.

Incidentally, a distance and a height between the absorb pads 51 and the pair of sheet supply rollers 4*a*, 4*b* and the timing for generating the absorbing force in the absorb pads 51 are selected so that the tip end of the uppermost sheet P' lifted by the absorb pads 51 is surely pinched between the sheet supply rollers 4*a* and 4*b*.

Next, a sheet supplying apparatus according to another embodiment of the present invention will be explained with reference to FIG. 7 which is a perspective view showing such a sheet supplying apparatus.

In this embodiment, a single movable member 42 is disposed above the sheets P stacked in the sheet cassette 2 at a central portion of the sheet in its width-wise direction, and an pivot arm 61 is rotatably supported by a support portion 42*b* of the movable member 42 via a support shaft 47.

Figure 7:
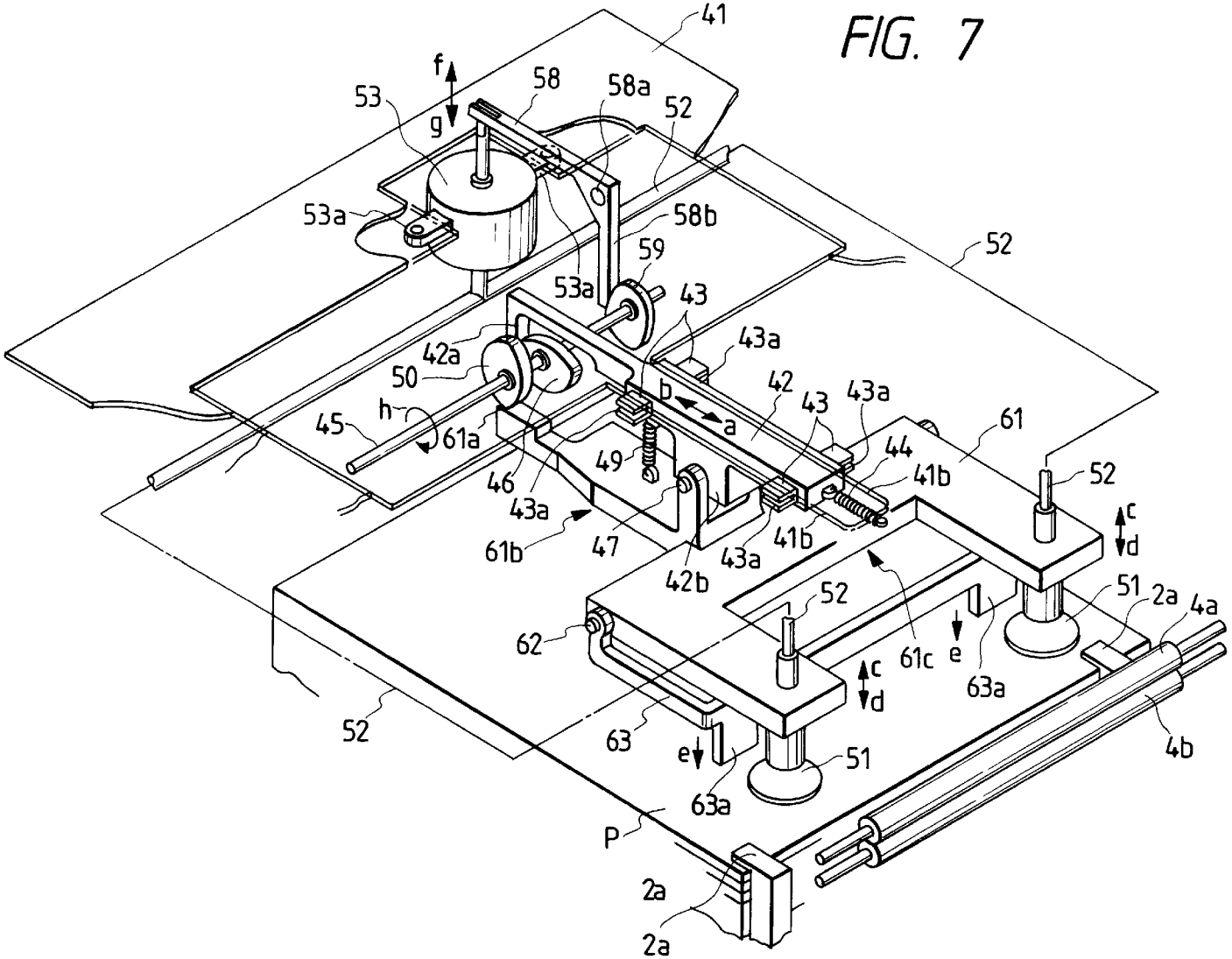
FIG. 7 is a perspective view of a sheet supplying apparatus according to another embodiment of the present invention.

As shown in FIG. 7, the pivot arm 61 is disposed below and along the movable member 42, and has a straight portion 61*b* provided at its free end with a cam abutment portion 61*a*, and a U-shaped portion 61*c* connected to the straight portion 61*b* and provided at its free ends with a pair of absorb pads 51. The pivot arm 61 is rotatably supported on the support shaft 47 at a position corresponding to the junction between the straight portion 61*b* and the U-shaped portion 61*c*. Between the movable member 42 and the pivot arm 61, there is provided a tension coil spring 49 disposed upstream of the support shaft 47 and downstream of the rotation drive shaft 45 in the sheet supplying direction so that the pivot arm 61 is always biased toward a direction d in FIG. 7 by a biasing force of the tension coil spring 49.

The cam abutment portion 61*a* provided on the free end (upstream end) of the straight portion 61*b* of the pivot arm 61 abuts against a cam 50 secured to the rotation drive shaft 45 to rotate therewith, so that the pivot arm 61 can be rocked in directions c, d in FIG. 7.

The pair of absorb pads 51 provided on the free ends (downstream ends) of the U-shaped portion 61*c* of the pivot arm 61 can be rocked around the support shaft 47 in the directions c, d in FIG. 7 within a predetermined range when the pivot arm 61 is rocked around the support shaft 47 by rotation of the cam 50. The absorb pads 51 is connected to the suction pump 53 secured to the main frame 41 through the tubes 52. By sucking the air from the interior of the absorb pads 51 through the tube 52 by the suction pump 53, the negative pressure is generated in the absorb pads, to thereby absorb the sheet P in the sheet cassette 2.

Upstream of the pair of absorb pads 51 provided on the U-shaped portion 61*c* of the pivot arm 61 and downstream of the support shaft 47 in the sheet supplying direction, there is provided a sheet holder 64 rotatably supported by the pivot arm 61 via support shafts 62 disposed downstream of and in the vicinity of the support shaft 47. The sheet holder 63 has a width substantially the same as a width of the U-shaped portion 61*c* of the pivot arm 61 and has a crank shape, and a pair of sheet abutment portions 63*a* for urging against the sheet stack P contained in the sheet cassette 2 to regulate the sheet stack P are provided on the sheet holder in correspondence to the pair of absorb pads 51.

Although not shown, as is in the aforementioned embodiment, stoppers provided on upper ends of the sheet abutment portions 63*a* are fitted in grooves formed in the U-shaped portion 61*c* of the pivot arm 61 and compression springs are mounted around the stoppers between the upper surfaces of the sheet abutment portions 63*a* and the lower surface of the pivot arm 61. Thus, the sheet holder 63 is always biased toward a direction e in FIG. 7 by the compression springs to rock downwardly around the support shafts 62 with respect to the pivot arm 61 and is held at a predetermined position by the stoppers. Further, the cam 46 and the cam 59 are secured to the rotation drive shaft 45 at predetermined positions.

This embodiment can suitably handle a sheet having a relatively small width. In comparison with the aforementioned embodiment, since the number of parts is reduced, the entire apparatus can be made cheaper.

Next, a sheet supplying apparatus according to a further embodiment of the present invention will be explained with reference to FIGS. 8 to 12.

Figure 8:
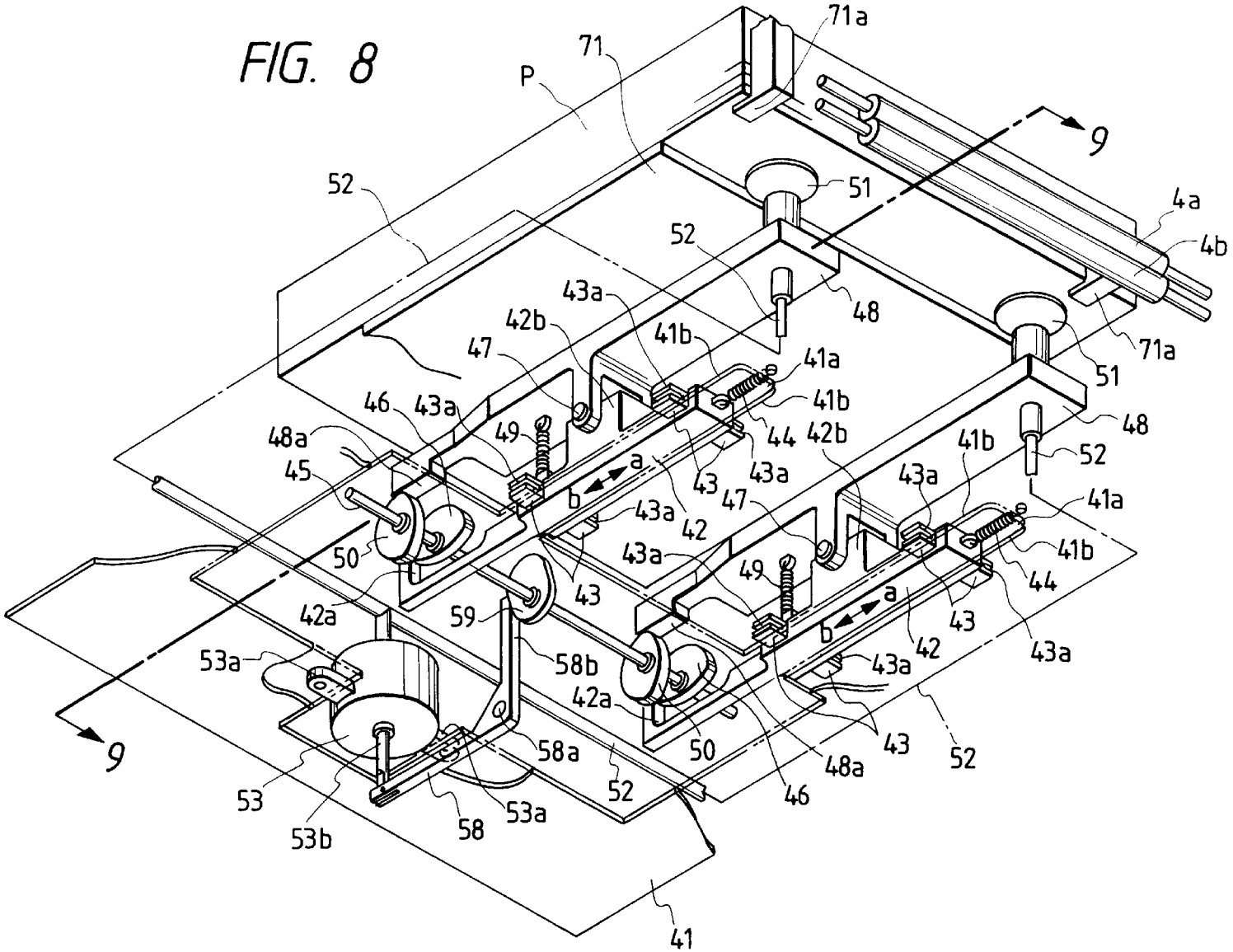
FIG. 8 is a perspective view of a sheet supplying apparatus according to a further embodiment of the present invention.

As shown in FIG. 8, this embodiment shows an example of a sheet supplying apparatus of lower sheet supply type in which sheets P stacked on a sheet tray 71 are supplied one by one from a lowermost sheet P. In place of the sheet cassette 2 in the first embodiment, a sheet tray (sheet stacking means) 71 on which sheets P are stacked is disposed at a lower part of the copying machine 1 of FIG. 1. The sheets P stacked on the sheet tray 71 are absorbed and lowered by a pair of absorb pads 51 disposed below the sheet tray 71, and only a lowermost sheet P" is released from separation pawls 71*a* (disposed downstream of the sheet tray 71 to regulate front corners of the sheet stack P) and is separated from the other overlying sheets P. The separated sheet is sent to a pair of sheet supply rollers 4*a*, 4*b*.

As shown in FIG. 8, a pair of notches 41*a* are formed in the main frame 41 of the copying machine 1 disposed below the sheet tray 71, and a pair of movable members 42 are received in the corresponding notches 41*a* for sliding movement in directions a, b in FIG. 8 along the notches 41*a*. More specifically, grooves 43*a* of four brackets 43 secured to lateral edges of each movable member 42 at predetermined positions are slidably fitted on lateral edges 41*b* of the corresponding notch 41*a*.

Tension coil springs 44 are disposed between portions of the main frame 41 at a downstream side of the notches 41*a* and downstream ends of the movable members 42, so that the pair of movable members 42 are always biased toward the direction a in FIG. 8 by the pulling forces of the tension coil springs 44.

On the other hand, cam abutment portions 42*a* extending downwardly in perpendicular to a longitudinal direction of the movable member 42 are integrally formed on upstream ends of the movable members 42. The cam abutment portions 42*a* abut against a pair of cams 46 secured to a rotation drive shaft 45 rotatably supported by the main frame 41, so that the movable members 42 can be shifted in the directions a, b in FIG. 8 in accordance with the rotation of the cams. The pair of movable members 42 and the pair of cams 46 constitute a shift means.

Figure 9:
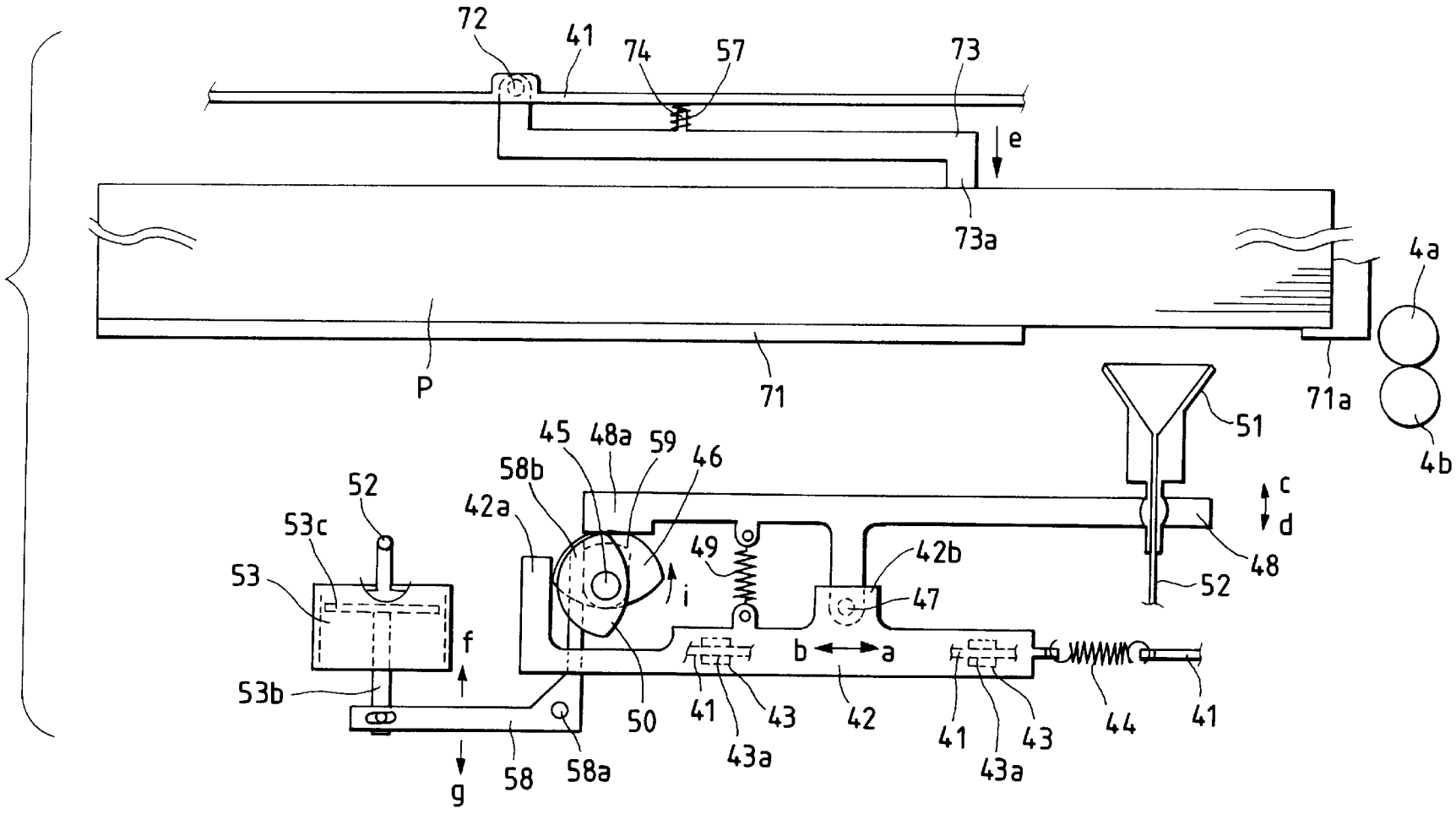
FIGS. 9, 10, 11 and 12 are sectional views taken along the line 9—9 in FIG. 8, showing sheet supplying conditions.

Each movable member 42 has a support portion 42*b* protruded upwardly from a central portion of the movable member between the brackets 43, and a pivot arm 48 is supported on a support shaft 47 provided on the support portion 42*b* for pivotal movement in directions c, d in FIG. 9. A tension coil spring 49 is disposed between the respective movable member 42 and the corresponding pivot arm 48 upstream of the support shaft 47 and downstream of the rotation drive shaft 45 in the sheet supplying direction, so that the pivot arm 48 is always biased toward the direction c in FIG. 9 by the pulling force of the tension coil spring 49.

On the other hand, cam abutment portions 48*a* are integrally formed with upstream ends of the pair of pivot arms 48. The cam abutment portions 48*a* abut against a pair of cams 50 secured to the rotation drive shaft 45 to rotate therewith, so that the pivot arms 48 can be rocked in the directions c, d in FIG. 9 in accordance with the rotation of the cams. A pair of absorb pads 51 are provided on downstream ends of the pair of pivot arms 48. Thus, when the pair of pivot arms 48 are rocked around their support shafts 47 by the rotation of the pair of cams 50, the absorb pads 51 attached to the ends of the respective pivot arms 48 are rocked in the directions c, d in FIG. 9 around the support shafts 47 within a predetermined range.

The absorb pads 51 are connected, via tubes 52, to a suction pump 53 secured to the main frame 41. By sucking air from the interior of the absorb pads 51 by the suction pump 53 through the tubes 52 to generate negative pressure in the absorb pads, the sheets rested on the sheet tray 71 can be absorbed by the absorb pads.

A movable rod 53*b* of the suction pump 53 is connected to one end of a link member 58 rotatably supported by the main frame 41 via a fulcrum 58*a*, and the other end of the link member 58 is provided with a cam abutment portion 58*b*. The cam abutment portion 58*b* abuts against a cam 59 secured to the rotation drive shaft 45 to rotate therewith, so that the link member 58 is rotated around the fulcrum 58*a* in directions f, g in FIG. 9 to reciprocally shift a partition wall 53*c* within the suction pump 53 via the movable rod 53*b* connected to the link member 58 to change the internal volume of the suction pump 53, to thereby generate the negative pressure during one-way stroke of the partition wall 53*c*.

The rotation drive shaft 45 is connected to a drive source to be rotated thereby so that the cams 46, 50, 59 are simultaneously rotated in a direction i in FIG. 9. The pair of cams 46 can shift the pair of movable members 42 in the directions a, b in FIG. 9, the pair of cams 50 can shift the pair of pivot arms 48 in the directions c, d in FIG. 9, and the cam 59 can drive the suction pump 53 via the link member 58.

As shown in FIG. 9, regarding the cams 46, 50, 59 integrally secured to the rotation drive shaft 45, maximum lifts of the cams 50 are offset from maximum lifts of the cams 46 by about 90 degrees in the direction i in FIG. 9, and a maximum lift of the cam 59 has the same angular phase (i.e., is disposed at the same angular position) as the maximum lifts of the cams 46. The cams 46, 50 have high lift (large diameter) portions extending through about 180 degrees and low lift (small diameter) portions smoothly connected to the corresponding high lift portions, and the cam 59 has a high lift portion extending in one direction and having a predetermined width.

With the arrangement as mentioned above, the movable members 42 and the suction pump 53 are subjected to driving forces from the common drive source via the rotation drive shaft 45, and the movable members 42 and the suction pump 53 are operated in a synchronous manner.

As shown in FIG. 9, sheet holders 73 are disposed above the sheet tray 71 and are rotatably supported by the main frame 41 via support shafts 72 upstream of the absorb pads 51 of the pivot arms 48. The sheet holders 73 have sheet abutment portions 73*a* disposed downstream of the support shafts 47.

Each sheet holder 73 has a crank shape and also has an upper locking projection 74 around which a compression spring 57 is mounted between the lower surface of the main frame 41 and the upper surface of the sheet holder. By the biasing forces of the compression springs 57, the sheet holders 73 are always biased toward a direction e in FIG. 9 to abut the sheet abutment portions 73*a* against the sheet stack P, to thereby regulate the sheet stack.

In the illustrated embodiment, the absorb pads 51, pivot arms 48, sheet holders 73 and movable members 42 are arranged in pair spaced apart from by a predetermined distance to handle a sheet P having a relatively great width. Now, an operation of the sheet supplying apparatus having the above-mentioned construction will be explained with reference to FIGS. 9 to 12.

FIG. 9 shows a waiting condition before the sheet P is supplied. In this condition, start ends of the high lift portions of the cams 46 abut against the cam abutment portions 42*a* of the movable members 42. Thus, the movable members 42 are maintained at left (FIG. 9) limit ends of their strokes in opposition to the biasing forces of the tension coil springs 44, and the absorb pads 51 are spaced apart from the lower surface of the sheet stack P rested on the sheet tray 71 by a predetermined distance.

In this case, finish ends of the high lift portions of the cams 50 abut against the cam abutment portions 48*a* of the pivot arms 48, to lower the pivot arms 48 in the direction d in FIG. 9 in opposition to the biasing forces of the tension coil springs 49 so that the pivot arms 48 are maintained substantially horizontally, and the absorb pads 51 are spaced apart from the sheet stack P rested on the sheet tray 71.

Further in this case, the low lift portion of the cam 59 abuts against the cam abutment portion 58*b* of the link member 58, so that the movable rod 53*b* of the suction pump 53 is stopped at a lifted position (before lowered in the direction g in FIG. 9). Thus, in this case, the negative pressure is not generated by the suction pump 53. The sheet holders 73 are biased toward the direction e in FIG. 9 by the compression springs 57 to abut against the sheet stack P rested on the sheet tray 71, to thereby always bias the sheets P on the sheet tray 71 downwardly.

When the copy start button is depressed, the rotation drive shaft 45 is rotated in the direction i in FIG. 9 by the rotational driving force from the drive source, so that the cams 46, 50, 59 integrally secured to the rotation drive shaft 45 are also rotated in the direction i in FIG. 9.

The high lift portions of the cams 46 continue to slidingly contact with the cam abutment portions 42*a* of the movable members 42 to maintain the movable members 42 at their left limit ends until the rotation drive shaft 45 is rotated by about 180 degrees. On the other hand, the lift portions of the cams 50 which abut against the cam abutment portions 48*a* of the pivot arms 48 are gradually transferred from the high lift portions to the low lift portions, to thereby rock the pivot arms 48 around the support shafts 47 in the direction c in FIG. 10 by the biasing forces of the tension coil springs 49, so that the absorb pads 51 are lifted to be urged against the lowermost sheet P" of the sheet stack P rested on the sheet tray 71.

Figure 10:
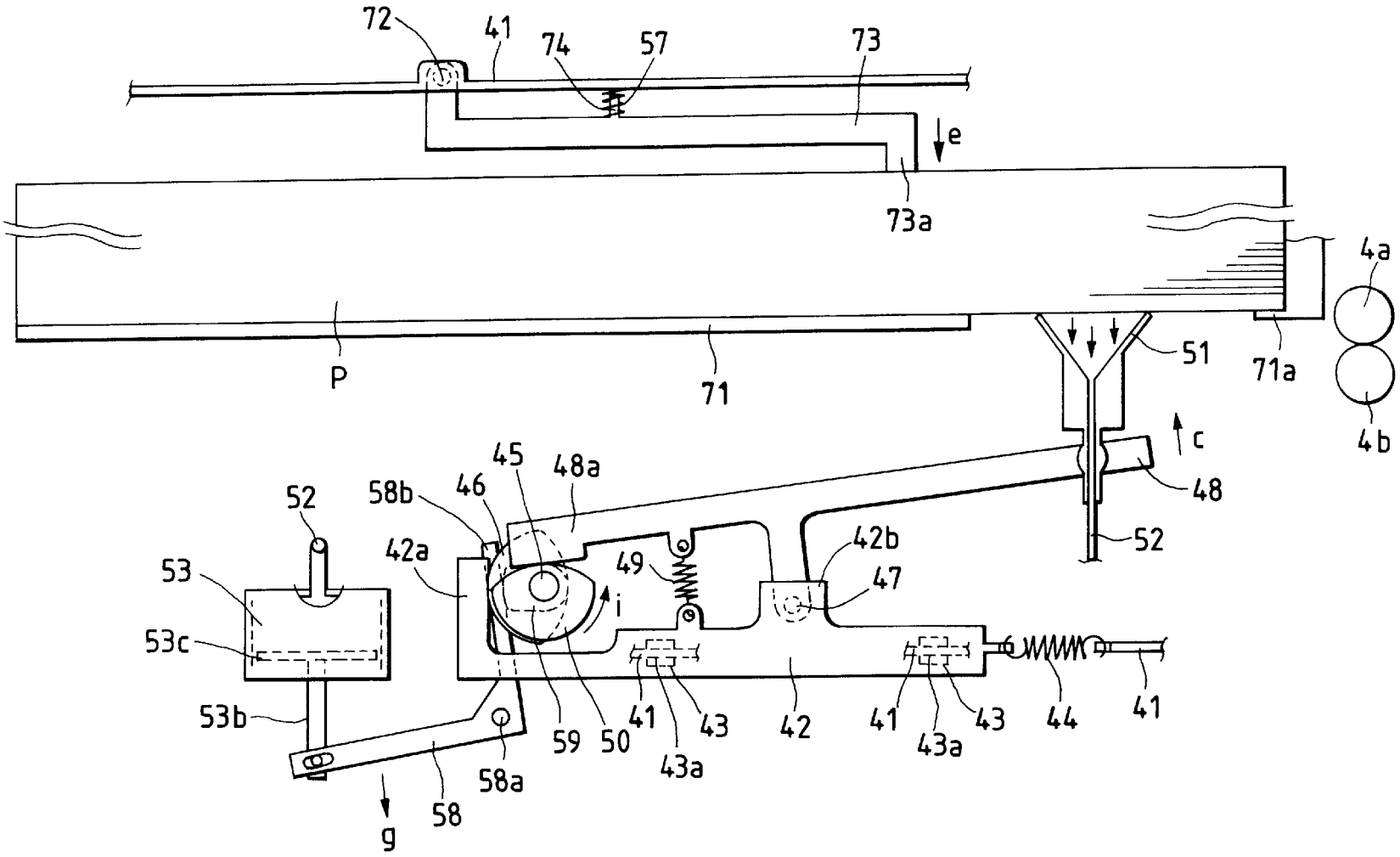

In this case, since the high lift portion of the cam 59 slidingly contacts with the cam abutment portion 58*b* of the link member 58, the link member 58 is rotated around the fulcrum 58*a* in the direction g in FIG. 10, with the result that the movable rod 53*b* connected to the end of the link member 58 is lowered to generate the negative pressure in the suction pump 53. Consequently, the negative pressure is generated in the absorb pads 51 connected to the suction pump 53 via the tubes 52, to thereby absorb the lowermost sheet P" by the absorb pads 51.

Figure 11:
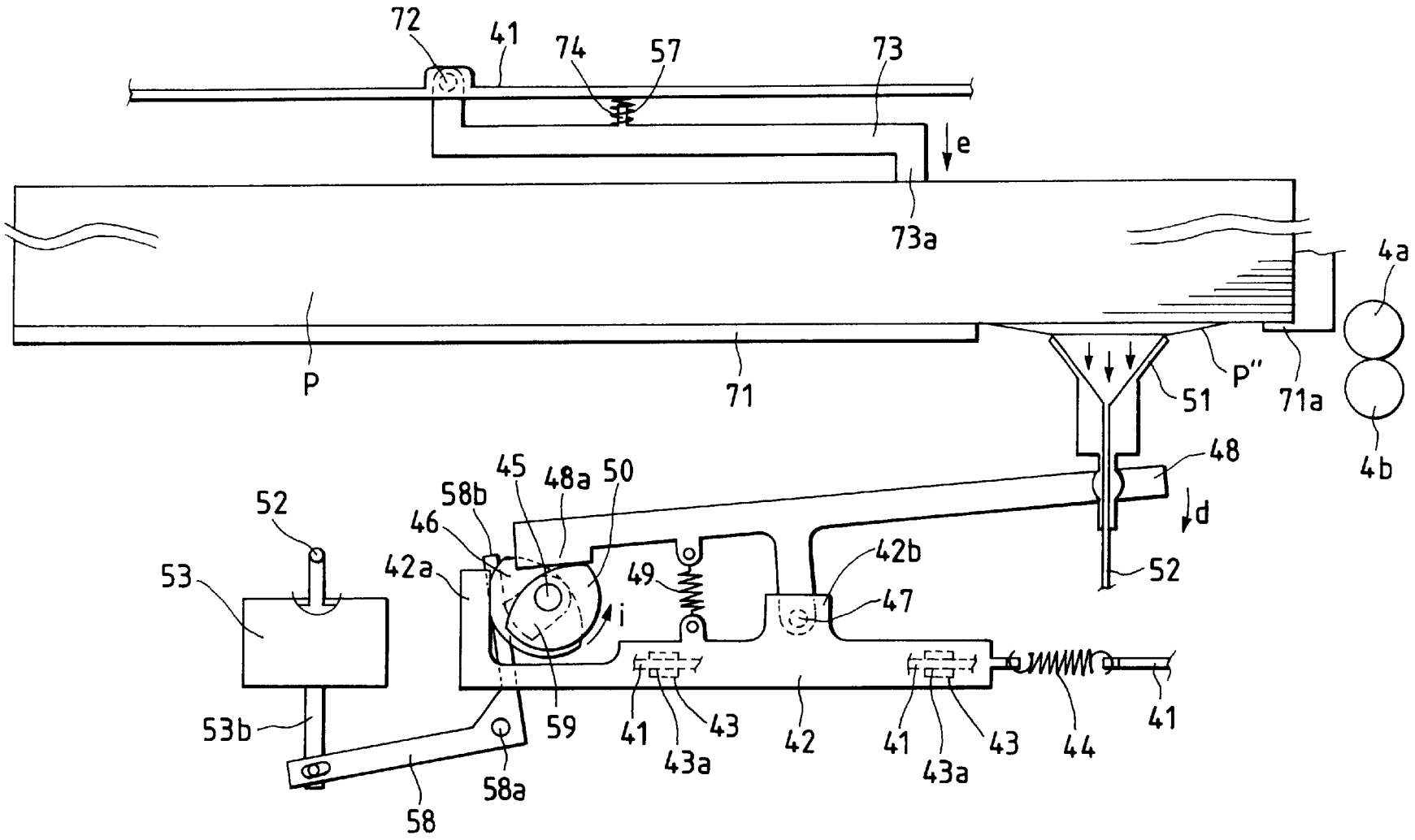

When the rotation drive shaft 45 is further rotated in the direction i in FIG. 10, as shown in FIG. 11, transient lift portions (having intermediate radii) of the cams 50 (which smoothly extend from the low lift portions to the start ends of the high lift portions) slidingly contact with the cam abutment portions 48*a* of the pivot arms 48 to slightly rotate the pivot arms 48 around the support shafts 47 in the direction d in FIG. 11, to thereby slightly lower the absorb pads 51 now absorbing the lowermost sheet P" from the sheet tray 71.

In this case, since the high lift portions of the cams 46, 59 slidingly contact with the cam abutment portions 42*a* of the movable members 42 and the cam abutment portion 58*b* of the link member 58, respectively, the previous conditions are maintained. On the other hand, the sheet abutment portions 73*a* of the sheet holders 73 are still urged toward the direction e in FIG. 11 by the biasing forces of the compression springs 57 to still regulate the sheet stack P. When the front corners of the lowermost sheet P" absorbed and lowered by the absorb pads 51 ride over the separation pawls 2*a*, the lowermost sheet is released from the separation pawls 2*a*.

The absorbing force acting on the lowermost sheet P" from the absorb pads 51 is greater than the absorbing force acting on the other overlying sheets from the absorb pads. Thus, in the sheet stack P regulated by the separation pawls 2*a* and held down by the sheet holders 73, the absorbing force of the absorb pads 51 acting on the lowermost sheet P" overcomes the resiliency of the lowermost sheet to ride the front corners of the lowermost sheet over the separation pawls 2*a*. Whereas, the absorbing force acting on the other sheets cannot overcome the resiliency of the sheet, so that the other sheets are still regulated by the separation pawls 2*a*. In this way, the lowermost sheet P" is separated from the other overlying sheets P.

Figure 12:
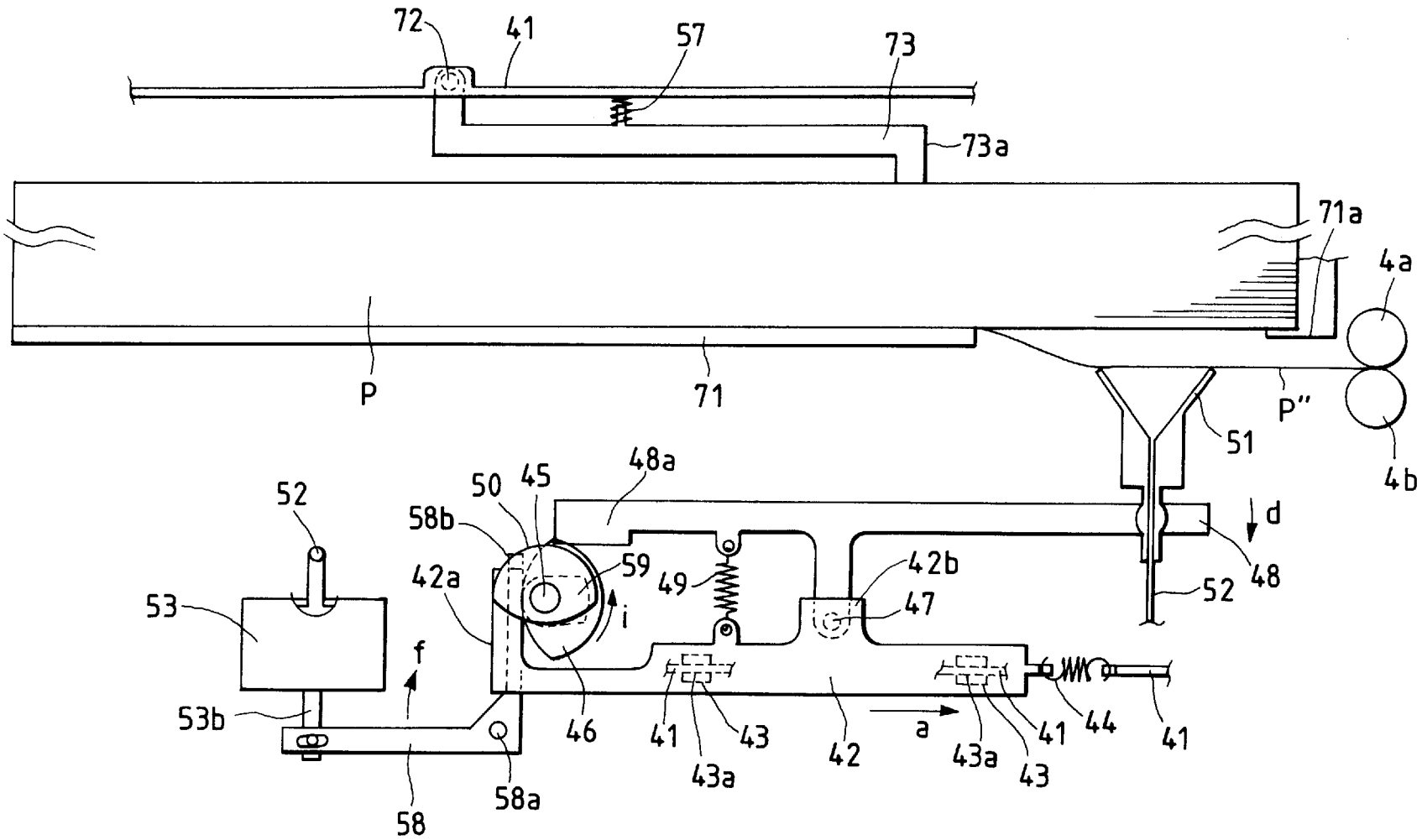

When the rotation drive shaft 45 is further rotated in the direction i in FIG. 11, as shown in FIG. 12, the high lift portions of the cams 50 slidingly contact with the cam abutment portions 48*a* of the pivot arms 48 to further rotate the pivot arms 48 in the direction d in FIG. 12, to thereby lower the absorb pads 51 now absorbing the lowermost sheet P". The pivot arms 48 are held substantially horizontally.

In this case, as shown in FIG. 12, the lift portions of the cams 46 which abut against the cam abutment portions 42*a* of the movable members 42 are transferred from the high lift portions to the low lift portions, to thereby shift the pair of movable members 42 in the direction a in FIG. 12 along the respective notches 41*a* by the biasing forces of the tension coil springs 44. As a result, the pivot arms 48 held horizontally are shifted together with the movable members 42 in the direction a in FIG. 12, to thereby introduce a tip end of the lowermost sheet P" absorbed by the absorb pads 51 into the nip between the pair of sheet supply rollers 4*a* and 4*b*. In this way, the uppermost sheet is supplied by the rollers 4*a*, 4*b*.

Further in this case, the lift portion of the cam 59 which abuts against the cam abutment portion 58*b* of the link member 58 is transferred from the high lift portion to the low lift portion, to thereby rotate the link member 58 around the fulcrum 58*a* in the direction f in FIG. 12. As a result, the movable rod 53*b* connected to the link member 58 is lifted to restore the suction pump 53 in the non-negative pressure generating condition. When the movable rod 53*b* is lifted, positive pressure is prevented from being generated in the suction pump by a valve mechanism (not shown).

Incidentally, a distance and a height between the absorb pads 51 and the pair of sheet supply rollers 4*a*, 4*b* and the timing for generating the absorbing force in the absorb pads 51 are selected so that the tip end of the uppermost sheet P' lifted by the absorb pads 51 is surely pinched between the sheet supply rollers 4*a* and 4*b*.

Next, a sheet supplying apparatus according to a still further embodiment of the present invention will be explained with reference to FIGS. 13 to 17.

Figure 13:
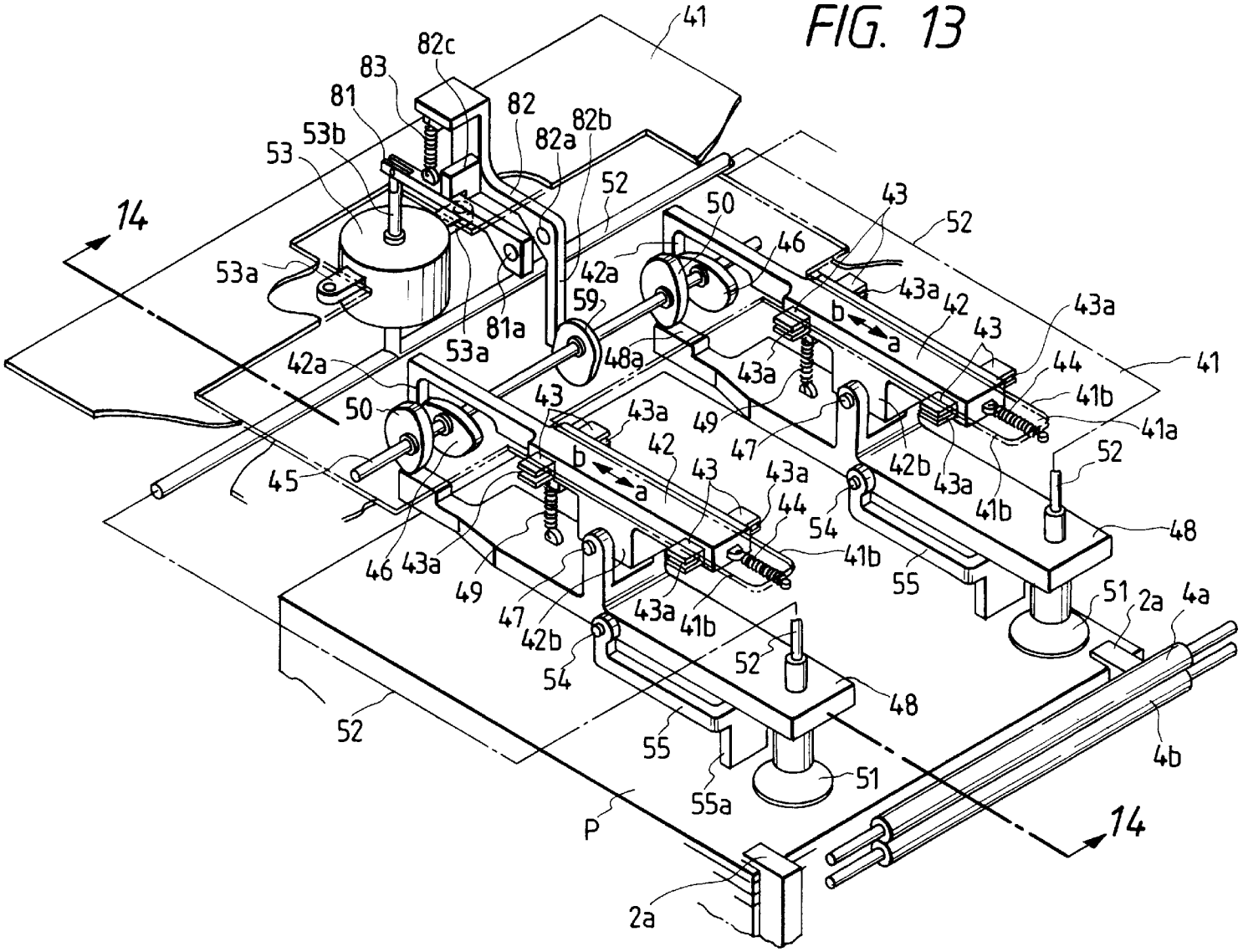
FIG. 13 is a perspective view of a sheet supplying apparatus according to a still further embodiment of the present invention.

A suction pump 53 according to this embodiment has a capacity for ensuring the negative pressure providing a predetermined absorbing force even when a sheet P such as a plain sheet having relatively great permeability is used. As shown in FIG. 13, a movable rod 53*b* of the suction pump 53 is connected to a straight-shaped first link member 81 rotatably supported by the main frame 41 via a fulcrum 81*a*.

An L-shaped second link member 82 rotatably supported by the main frame 41 via a fulcrum 82*a* coaxial with the fulcrum 81*a* of the first link member 81 is disposed in parallel with the first link member 81. The second link member 82 is provided at its end with a cam abutment portion 82*b* which abuts against a cam 59 secured to the rotation drive shaft 45 to rotate therewith, so that the second link member 82 can be rocked around the fulcrum 82*a* in directions f, g in FIG. 14.

The second link member 82 is further provided with a projection 82*c* which is contacted with an upper surface of the first link member 81, and a tension coil spring 83 is disposed between the first link member 81 and the second link member 82. By the biasing force of the tension coil spring 83, the first link member 81 is always biased toward the second link member 82 to abut the upper surface of the first link member 81 against the projection 82*c* of the second link member 82.

The first link member 81, second link member 82 and tension coil spring 83 constitute an absorbing force adjusting means. When the second link member 82 is not rotated by the cam 59, a waiting condition shown in FIG. 14 is maintained.

Figure 14:
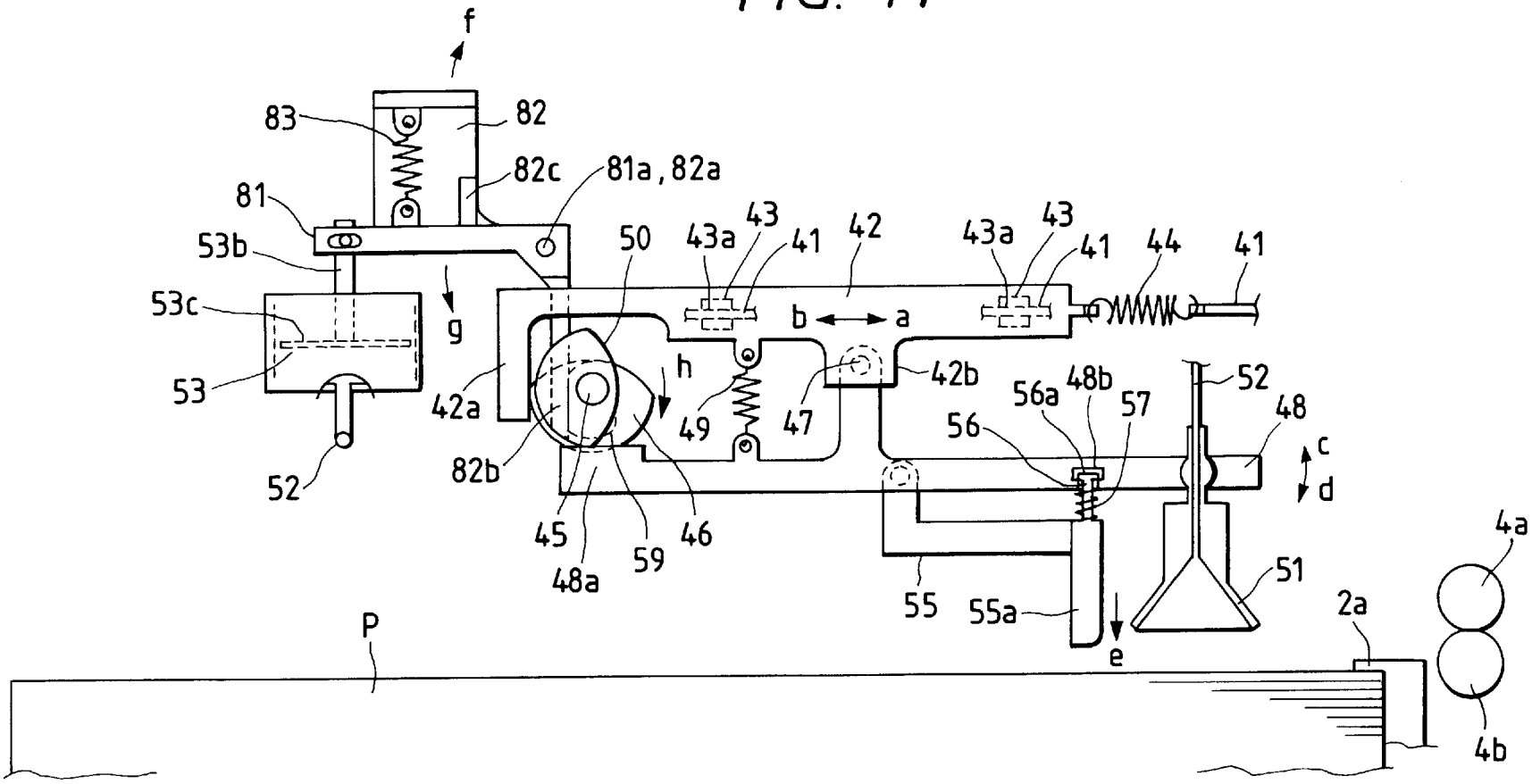
FIGS. 14, 15, 16 and 17 are sectional views taken along the line 14—14 in FIG. 13, showing sheet supplying conditions.
Figure 15:
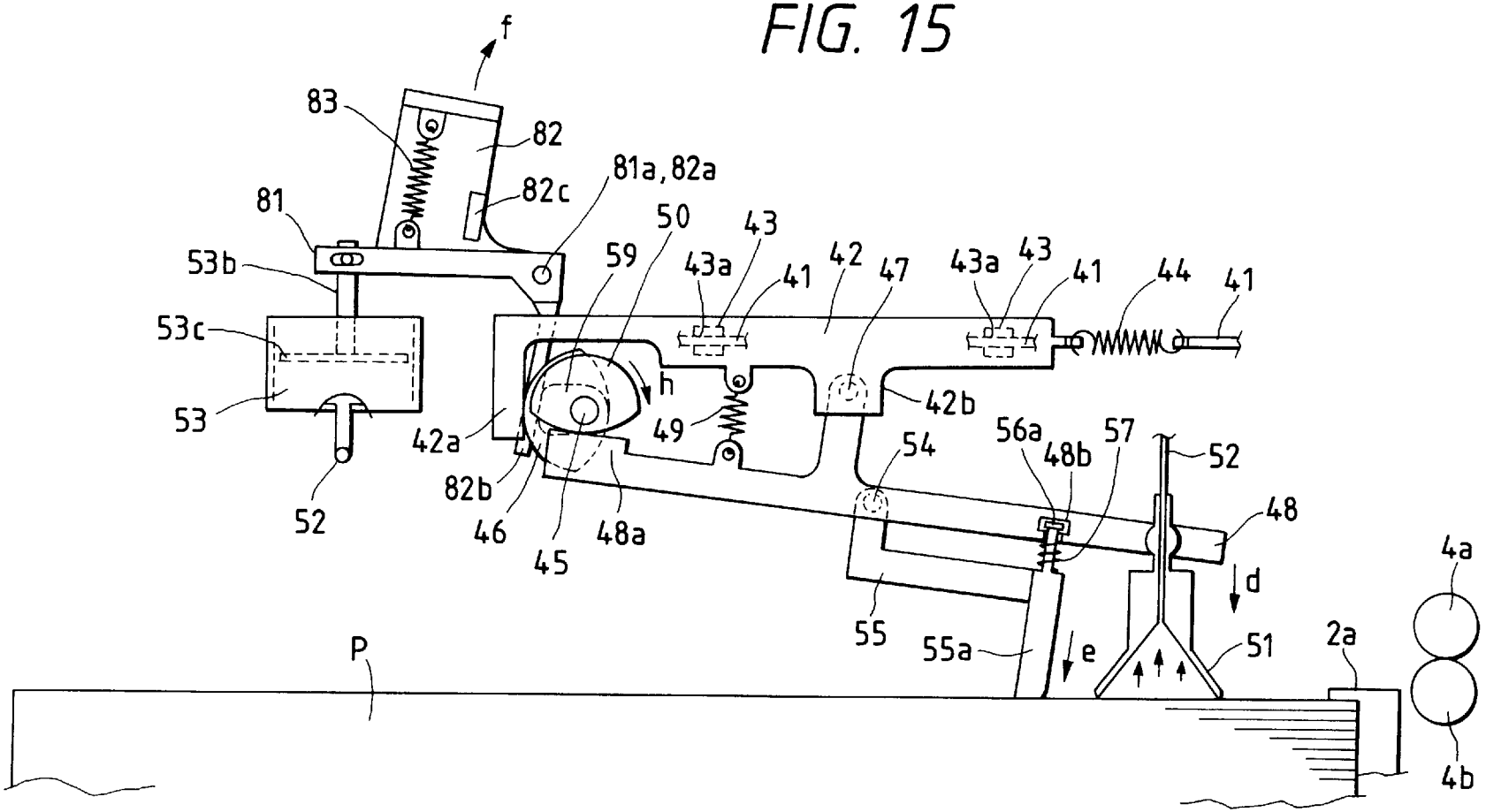

When the rotation drive shaft 45 is rotated in the direction h in FIG. 14 to cause the cam 59 (rotated together with the rotation drive shaft 45) abutting against the cam abutment portion 82*b* of the second link member 82 to rotate the second link member 82 around the fulcrum 82*a* in the direction f in FIG. 15, the first link member 81 is rotated around the fulcrum 81*a* in the direction f in FIG. 15 by a predetermined angle via the tension coil spring 83, so that the movable rod 53*b* connected to the end of the first link member 81 is lifted to generate the predetermined negative pressure in the suction pump 53. The tension coil spring 83 is selected so that excessive negative pressure greater than the predetermined negative pressure is not generated in the suction pump 53.

This embodiment is applicable to a sheet (for example, resin film sheet) having relatively small permeability. In this case, the value of the negative pressure generated in the suction pump 53 is reduced by decreasing the lift amount of the movable rod 53*b* of the suction pump 53 by the absorbing force adjusting means. As a result, even when the sheet P such as resin film sheet having relatively small permeability is absorbed by the absorb pads 51, the sheet is not deformed or excessive load does not act on the absorb pads 51 and the suction pump 53, to thereby prevent the deterioration of the pads and pump and useless energy consumption. By setting the negative pressure value or suction capacity of the suction pump 53 in correspondence to the sheet such as plain sheet having relatively great permeability and by appropriately changing the elastic coefficients of the tension coil springs 44 in dependence upon the permeability of the sheet when a sheet such as resin film sheet having relatively small permeability is used, the absorbing force of the absorb pads 51 can easily be controlled in accordance with the permeability of the sheet P and the value of the absorbing force can easily be adjusted.

That is to say, as shown in FIG. 15, the high lift portion of the cam 59 slidingly contacts with the cam abutment portion 82*b* of the second link member 82 to rotate the second link member 82 around the fulcrum 82*a* in the direction f in FIG. 15 and the first link member 81 is rotated around the fulcrum 81*a* in the direction f in FIG. 15 via the tension coil spring 83 to lift the movable rod 53*b* of the suction pump 53, to thereby generate the negative pressure in the suction pump 53. However, when the permeability of the sheet P is relatively small, since only small amount of external air is absorbed into the absorb pads 51, the negative pressure of the suction pump 53 reaches the value sufficient to absorb the sheet P relatively early.

When the second link member 82 is further rotated in the direction f in FIG. 15 to further rotate the first link member 81 in the direction f in FIG. 15, to thereby further lift the movable rod 53*b*, the negative pressure in the suction pump 53 is excessively increased to shift a partition wall 53*c* in the suction pump 53 downwardly (FIG. 15) by the action of the negative pressure in the suction pump 53, to thereby lower the movable rod 53*b* connected to the partition wall 53*c*.

As a result, the tension coil spring 83 is lowered until the negative pressure in the suction pump 53 is balanced with the biasing force of the tension coil spring 83. In this condition, even when the rotational amount of the second link 82 in the direction f in FIG. 15 is further increased, the rotational amount of the second link 82 in the direction f in FIG. 15 is absorbed by extending the tension coil spring 83. Thus, the first link member 81 is not excessively rotated in the direction f in FIG. 15, to thereby prevent the excessive increase in negative pressure in the suction pump 53. Consequently, the absorb pads 51 can absorb the sheet P with moderate absorbing force which is not excessive.

Figure 16:
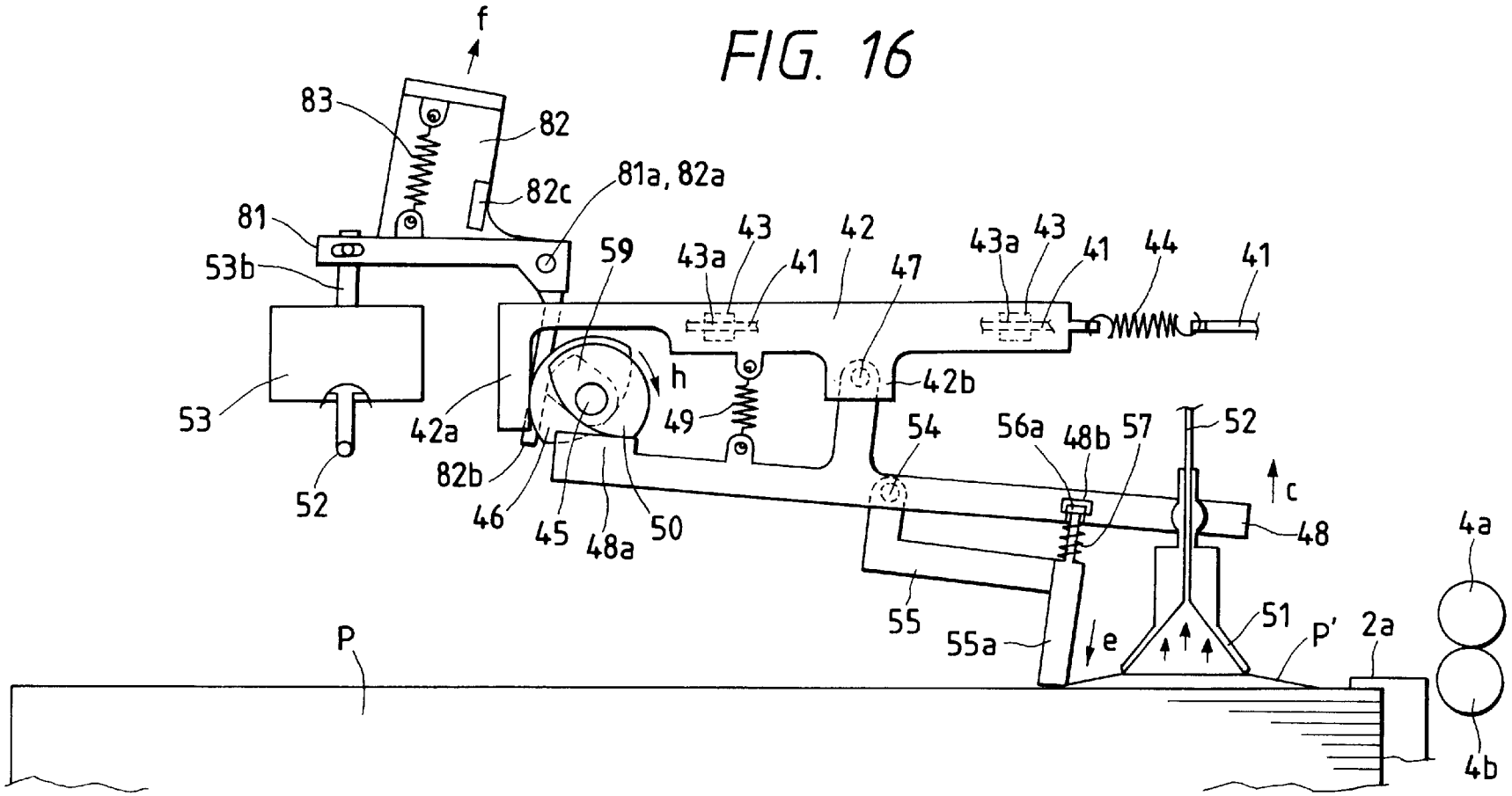
Figure 17:
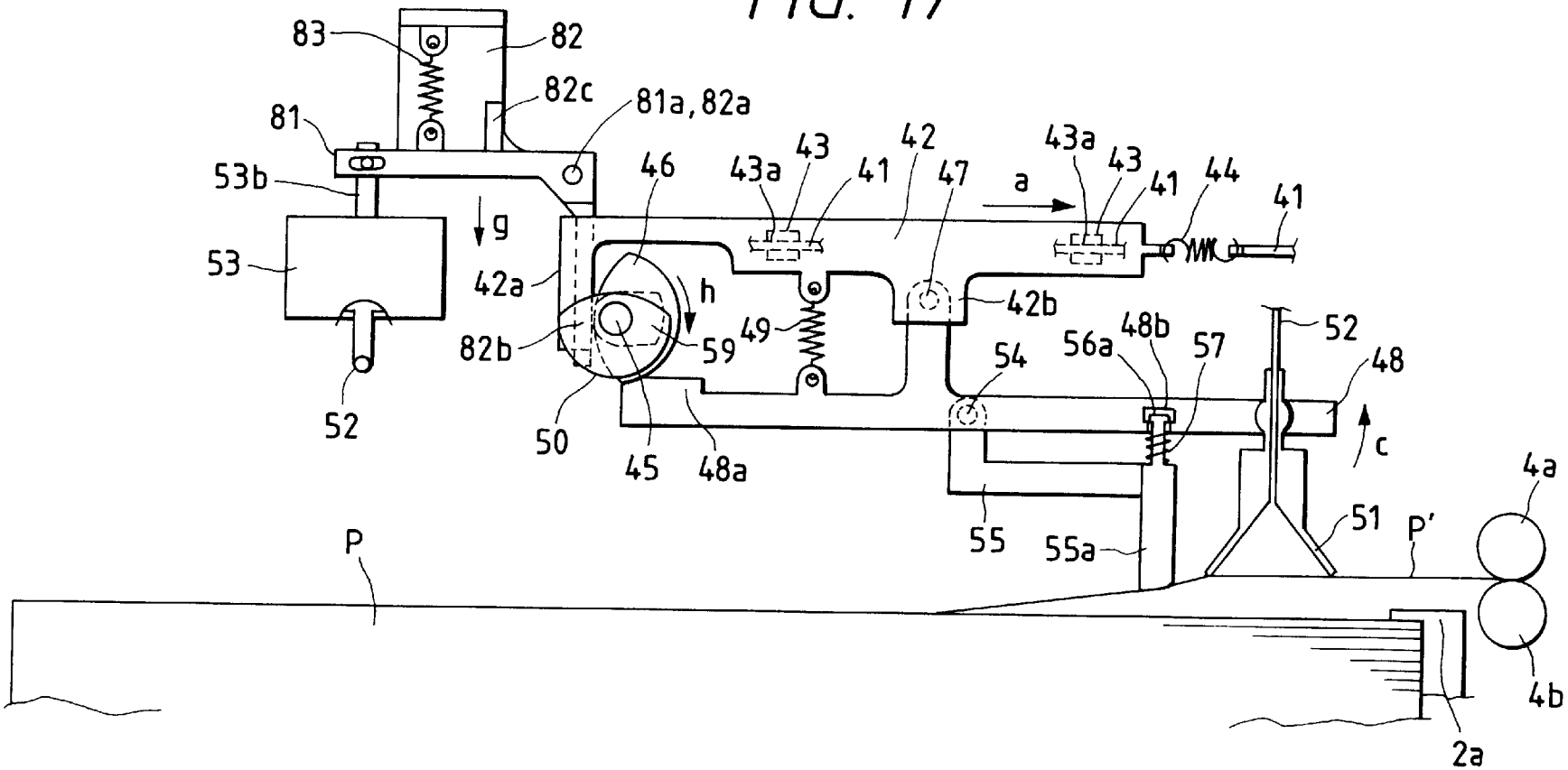

Further, as shown in FIG. 16, in a condition that the uppermost sheet P' is absorbed by the absorb pads 51, when the pivot arms 48 are lifted, the high lift portion of the cam 59 still abuts against the cam abutment portion 82*b* of the second link member 82 to tend to lift the movable rod 53*b* of the suction pump 53 upwardly (FIG. 16) via the second link member 82, tension coil spring 83 and first link member 81. However, as mentioned above, since only the second link member 82 is rotated in the direction f in FIG. 16 and the first link member 81 is not excessively rotated by the extension action of the tension coil spring 83, the first link member 81 is slightly rotated in the direction f in FIG. 16 by the energy accumulated in the tension coil spring 83 by an amount corresponding to the amount of the external air sucked into the absorb pads 51 through the sheet P. Thus, the predetermined negative pressure is maintained in the suction pump 53, so that the absorb pads 51 hold the uppermost sheet P'adhered thereto.

Next, a sheet supplying apparatus according to a further embodiment of the present invention will be explained with reference to FIGS. 18 to 22.

Figure 18:
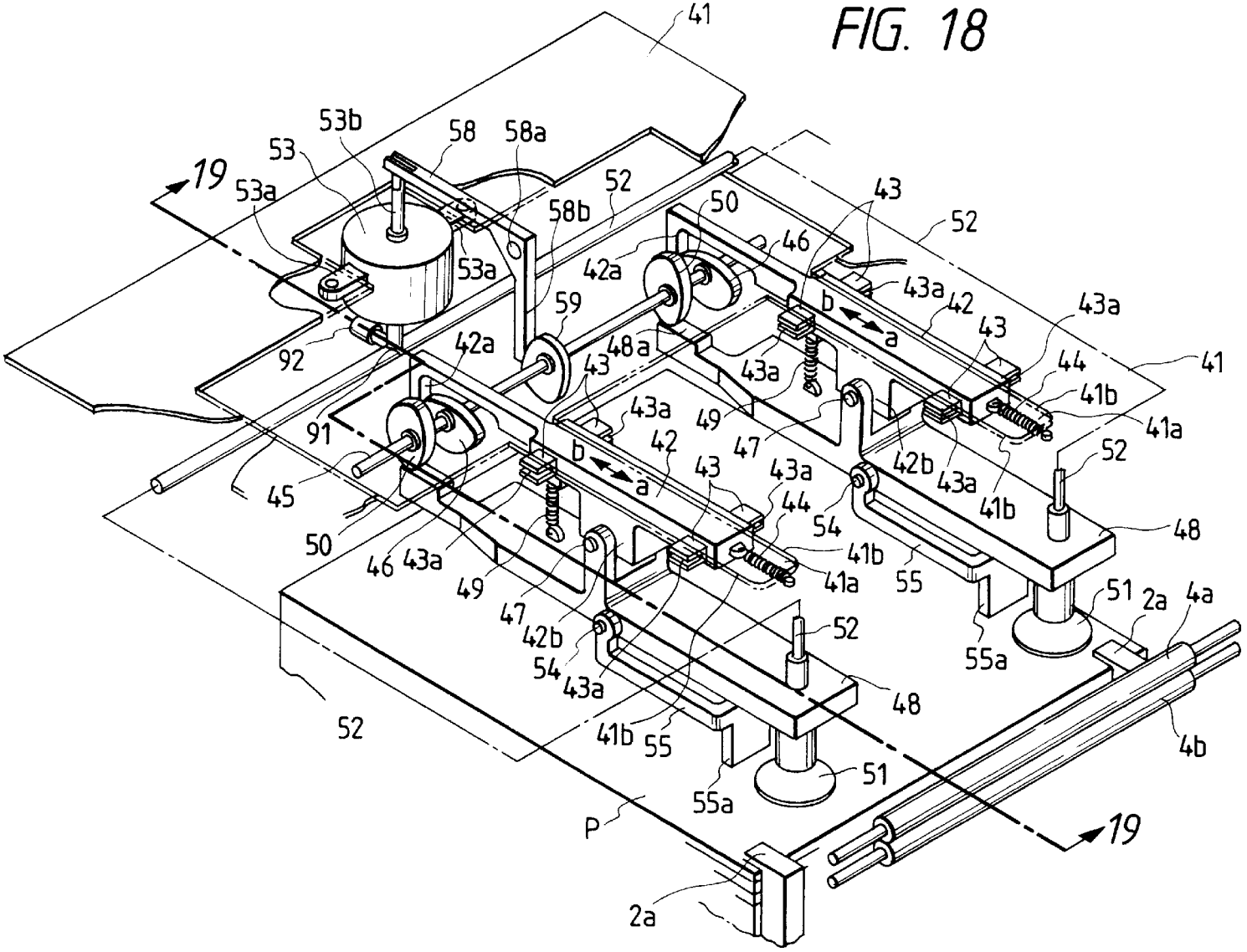
FIG. 18 is a perspective view of a sheet supplying apparatus according to a further embodiment of the present invention.
Figure 19:
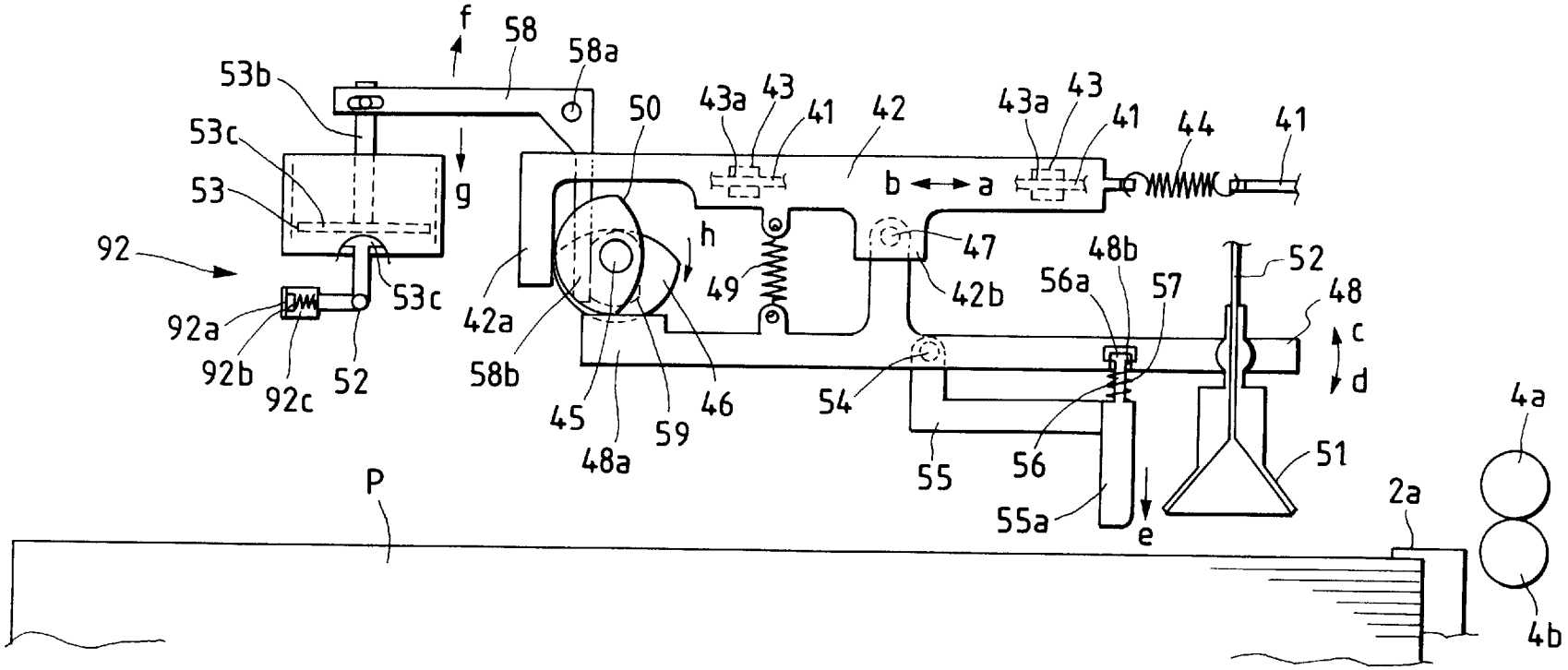
FIGS. 19, 20, 21 and 22 are sectional views taken along the line 19—19 in FIG. 18, showing sheet supplying conditions.

A suction pump (absorbing force generating means) 53 according to this embodiment has a capacity for ensuring the negative pressure providing a predetermined absorbing force even when a sheet P such as a plain sheet having relatively great permeability is used. As shown in FIG. 18, a check valve (absorbing force adjusting means) 92 is provided in the vicinity of an suction opening of the suction pump 53 at a junction 91 between the tubes 52. As shown in FIG. 19, the check valve 92 includes a hole 92*a* for communicating a negative pressure chamber 53*c* in the suction pump 53 with the atmosphere, a valve means 92*b* for opening and closing an air passage communicating with the hole 92*a*, and a compression coil spring 92*c* for biasing the valve means 92*b* toward the hole 92*a*.

The valve means 92*b* is always biased toward the left (FIG. 19) by the biasing force of the compression coil spring 92*c* to close the hole 92*a*. If the negative pressure in the absorb pads 51 and in the tubes 52 is decreased below the predetermined value, the valve means 92*b* is shifted to the right by the atmospheric pressure to open the hole 92*a*, to thereby introduce the atmosphere into the negative pressure chamber 53*c* of the suction pump 53 through the hole 92*a*. In this way, the excessive negative pressure greater than the predetermined value is prevented from generating in the suction pump 53.

This embodiment is also applicable to a sheet (for example, resin film sheet) having relatively small permeability. In this case, the value of the negative pressure generated in the suction pump 53 is controlled by the check valve 92 to reduce the negative pressure in the suction pump 53. As a result, even when the sheet P such as resin film sheet having relatively small permeability is absorbed by the absorb pads 51, the sheet is not deformed or excessive load does not act on the absorb pads 51 and the suction pump 53, to thereby prevent the deterioration of the pads and pump and useless energy consumption.

The negative pressure value or suction capacity of the suction pump 53 is previously set in correspondence to the sheet such as plain sheet having relatively great permeability. When a sheet such as resin film sheet having relatively small permeability is used, by appropriately changing the elastic coefficient of the compression coil spring 92*c* in dependence upon the permeability of the sheet P, the absorbing force of the absorb pads 51 can easily be controlled in accordance with the permeability of the sheet P and the value of the absorbing force can easily be adjusted.

Figure 20:
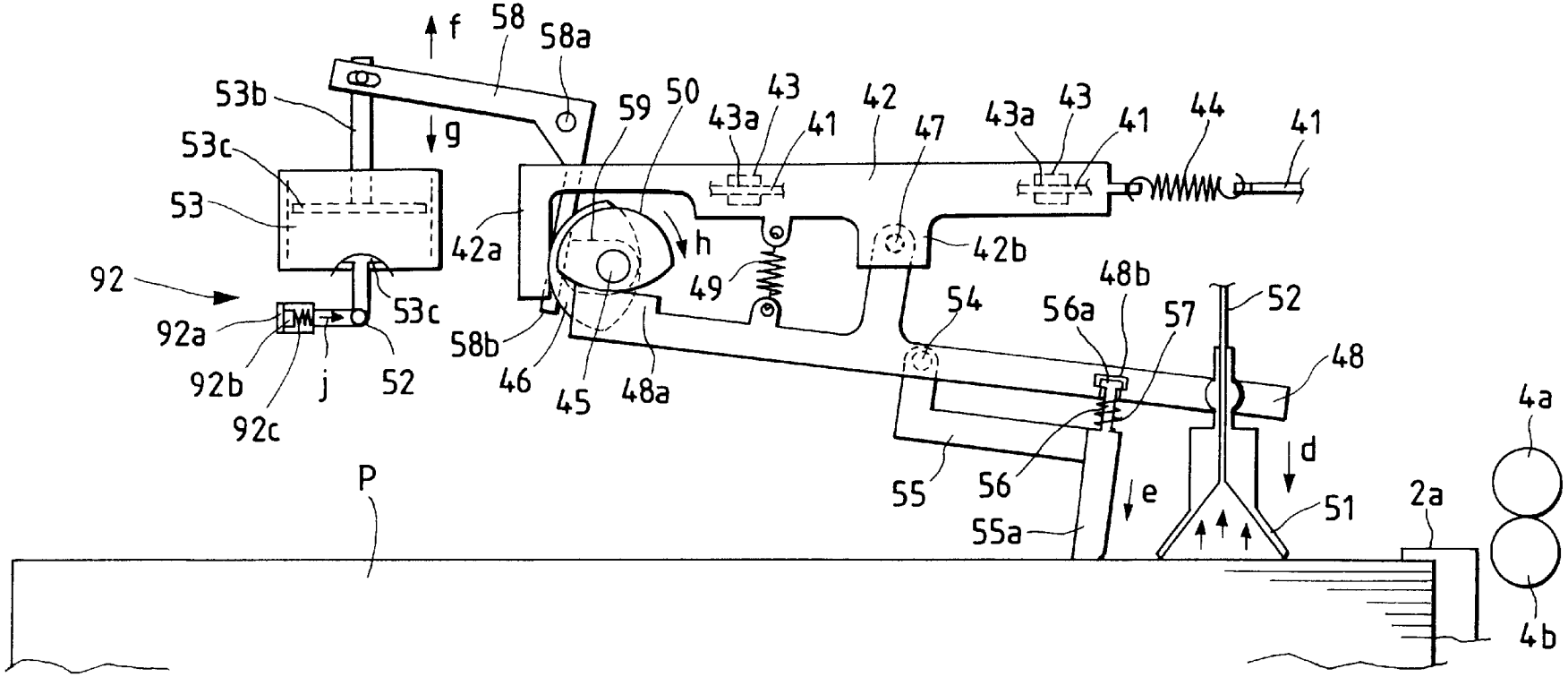

In FIG. 19, the hole 92*a* of the check value 92 is closed by the valve means 92*b* biased by the compression coil spring 92*c*. As shown in FIG. 20, when the cam 59 is rotated together with the rotation drive shaft 45 in the direction h in FIG. 20, the high lift portion of the cam 59 abuts against the cam abutment portion 58*b* of the link member 58 to rotate the link member 58 around the fulcrum 58*a* in the direction f in FIG. 20, to thereby lift the movable rod 53*b* of the suction pump 53. As a result, the negative pressure is generated in the suction pump 53. When the permeability of the sheet P is relatively small, since the amount of air sucked into the absorb pads 51 through the sheet P is relatively small, the value of negative pressure in the suction pump 53 is increased in excess of a value sufficient to absorb the sheet P and continues to be further increased.

However, when the negative pressure in the absorb pads 51 and the tubes 52 exceeds the predetermined value, since the atmospheric pressure overcomes the biasing force of the compression coil spring 92*c* for biasing the valve means 92*b*, the valve means 92*b* is shifted to the right (FIG. 20) to open the hole 92*a*, so that the atmosphere (air) enters into the negative pressure chamber 53*c* of the suction pump 53 in a direction shown by the arrow j in FIG. 20 to increase the pressure in the negative pressure chamber 53*c*, to thereby prevent the excessive negative pressure in the suction pump 53. As a result, the absorb pads 51 can absorb the sheet P with moderate absorbing force which is not excessive.

Figure 21:
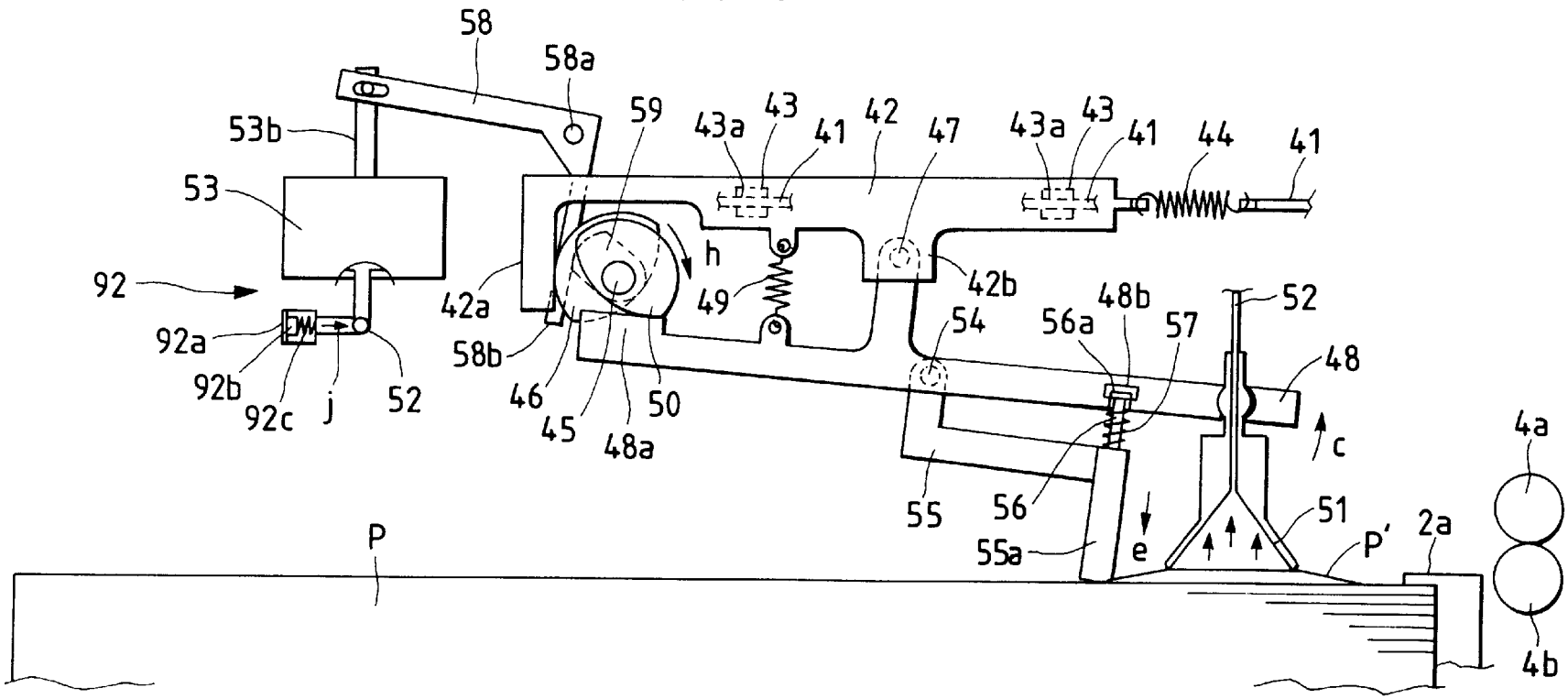

Further, as shown in FIG. 21, in a condition that the uppermost sheet P' is absorbed by the absorb pads 51, when the pivot arms 48 are lifted, the high lift portion of the cam 59 still abuts against the cam abutment portion 58*b* of the link member 58 and the check valve 92 is maintained substantially in the same condition as shown in FIG. 20. The valve means 92*b* is slightly shifted to the left in FIG. 21 by an amount corresponding to the air amount sucked into the absorb pads 51 through the sheet P, to thereby maintain the predetermined negative pressure in the suction pump 53. Thus, the absorb pads 51 hold the uppermost sheet P'adhered thereto.

Figure 22:
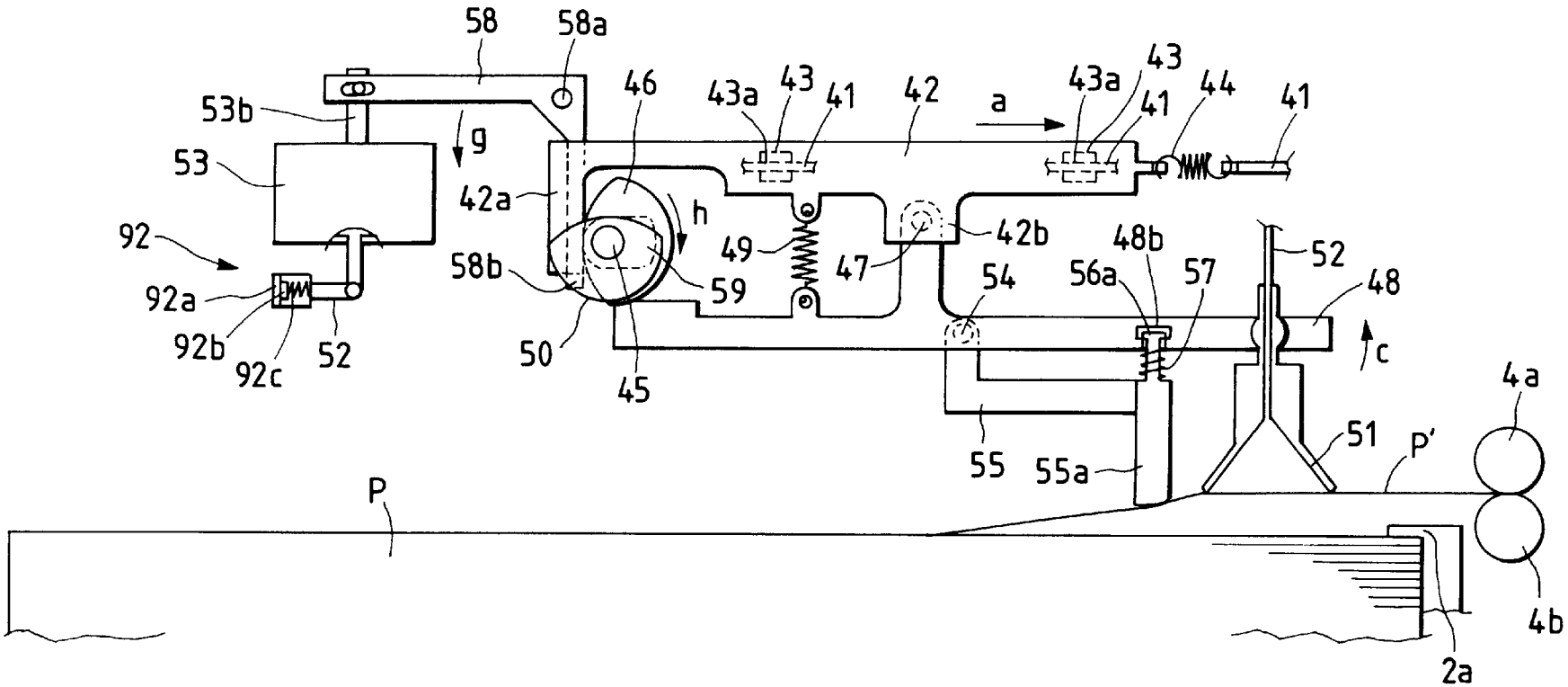

Further, as shown in FIG. 22, when the tip end of the sheet P is pinched between the pair of sheet supply rollers 4*a*, 4*b*, the suction pump 53 is restored to the non-negative pressure generating condition, and the hole 92*a* of the check valve 92 is closed by the valve means 92*b* biased by the compression coil spring 92*c*.

Figure 23:
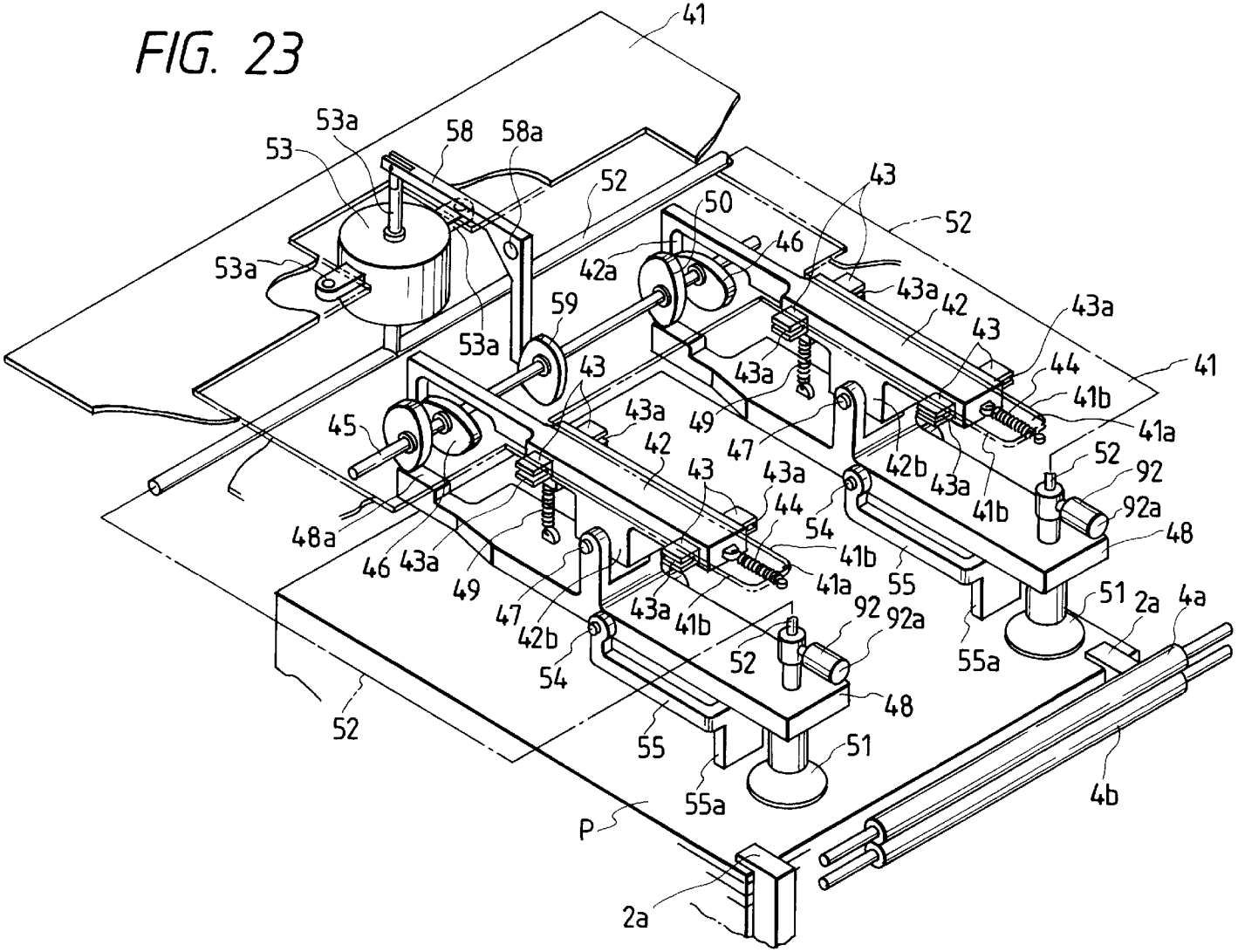
FIG. 23 is a perspective view of a sheet supplying apparatus according to a still further embodiment of the present invention.

Next, a sheet supplying apparatus according to a still further embodiment of the present invention will be explained with reference to FIG. 23. In this embodiment, a pair of check valves 92 are disposed above the respective absorb pads 51. In this case, since the negative pressure adjusting means are arranged in the vicinity of the respective absorb pads 51, the influence of fluid resistance in the tubes 52 can be avoided.

In the above-mentioned embodiments, while an example that the suction pump 53 receives the driving force from the rotation drive shaft 45 to which the cams for driving the movable members 42 and the pivot arms 48 are secured was explained, the movable members 42 and the pivot arms 48 are secured was explained, the movable rod of the suction pump 53 may be connected to the pivot arms 48 via a connection means so that the driving force is directly transmitted from the pivot arms 48 to the suction pump 53. Further, while an example that the single suction pump 53 is used was explained, a plurality of suction pumps 53 may be provided to cooperate with the respective absorb pads 51. In addition, three or more absorb pads 51 may be provided. Further, to maintain the predetermined negative pressure, in the check valve 92, the value of the negative pressure may be detected electrically by a sensor, and the hole 92*a* may be opened and closed by the valve means 92*b* by a solenoid or a motor through a control means.

In the sheet supplying apparatuses utilizing the vacuum absorbing system, the following problems arise.

Firstly, when the absorbing ability of the vacuum absorbing means (absorb pads) is set in dependence upon the sheet having small permeability, if a small number of sheets having great permeability are stacked, the absorbing force of the vacuum absorbing means will be decreased considerably. Secondly, when the absorbing force of the vacuum absorbing means is set in dependence upon the sheet having great permeability (in this case, a vacuum absorbing source having great capacity is required), if stacked sheets each has small permeability, the absorbing ability of the vacuum absorbing means will become too great, to thereby deform the sheet. Thirdly, if a large number of sheets having great permeability are stacked, since the entire permeability becomes smaller, the separation between a first sheet and a second sheet will become difficult and excessive load will act on the vacuum absorbing means or excessive energy will be consumed.

To solve these problems, an absorb auxiliary sheet for reducing the permeability of the sheet when the sheet is absorbed by the vacuum absorbing means will now be explained.

Figure 24:
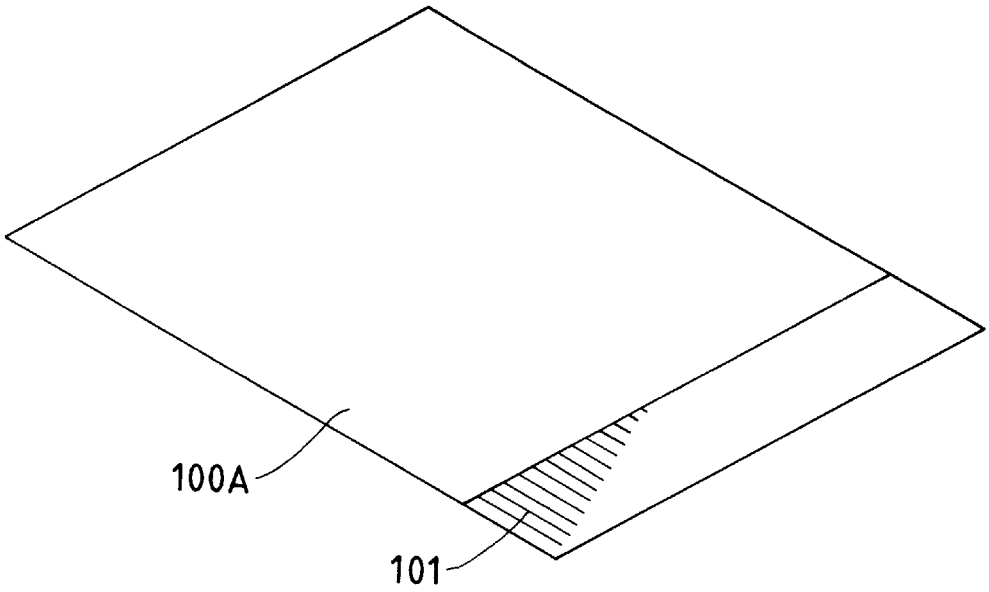
FIG. 24 is a perspective view showing an absorb auxiliary sheet used in the sheet supplying apparatus according to the present invention.

The absorb auxiliary sheet 100A is formed from a PET (polyethylene telephthalate) sheet having a thickness of 0.2 mm. As shown in FIG. 24, the absorb auxiliary sheet has a rectangular shape same as that of the sheet P and has a size slightly smaller than that of the sheet P. The absorb auxiliary sheet 100A is disposed within the sheet cassette 2 and the sheet stack P is rested on the absorb auxiliary sheet 100A.

The absorb auxiliary sheet 100A follows the upward movement of the lowermost sheet in the sheet cassette 2. To this end, an upstream end (in the sheet supplying direction) of the absorb auxiliary sheet 100A is secured to upstream end (shown by a hatched area in FIG. 25) of a lift/lower portion 2*b* in the sheet cassette 2 by adhesive and the like.

A Teflon layer 101 having low frictional coefficient is coated on a surface of the absorb auxiliary sheet 100A (disposed in the sheet cassette 2) facing to the absorb pads 51.

Now, when a small number of sheets having great permeability are stacked, a sheet supplying operation for supplying a sheet by utilizing the absorb auxiliary sheet 100A will be explained.

Figure 25:
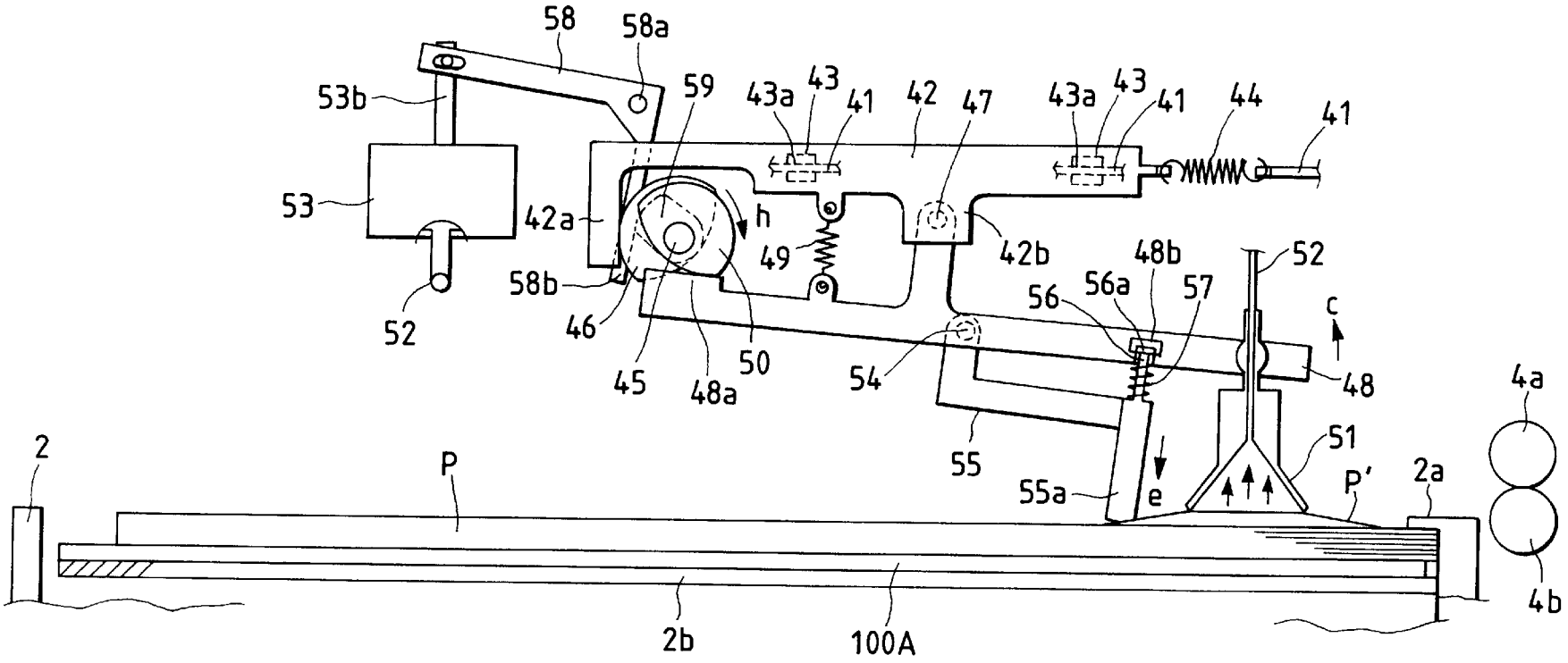
FIG. 25 is an explanatory view showing a condition that a sheet is supplied by using the absorb auxiliary sheet of FIG. 24.

As shown in FIG. 25, when the sheet P is lifted by the absorb pads 51 by utilizing the negative pressure generated in the suction pump 53, even if the permeability of the sheet P is great, the amount of air sucked into the absorb pads 51 is regulated by the absorb auxiliary sheet 100A having small permeability. Thus, the negative pressure in the suction pump 53 is increased to a value sufficient to absorb the sheet P. Consequently, the absorb pads 51 can absorb the sheet P with predetermined negative pressure.

By reducing the entire permeability of the stacked sheets in this way by utilizing the absorb auxiliary sheet 100A, even when the negative pressure generated by the suction pump 53 is set to a lower value, the sheet having small permeability can surely be absorbed, and, thus, the above problems can be solved. Regarding the sheet having great permeability, since the negative pressure required to absorb the sheet is small, the sheet is not deformed.

When the sheets P are absorbed by the absorb pads 51, the absorb auxiliary sheet 100A is also lifted together with the sheets to try to shift toward the sheet supplying direction. However, since the upstream end of the absorb auxiliary sheet 100A is secured to the lift/lower portion 2*b* in the sheet cassette 2, only the sheet is supplied. Regarding the lowermost sheet, since there is the Teflon layer 101, the lowermost sheet can be supplied with less resistance.

Figure 26:
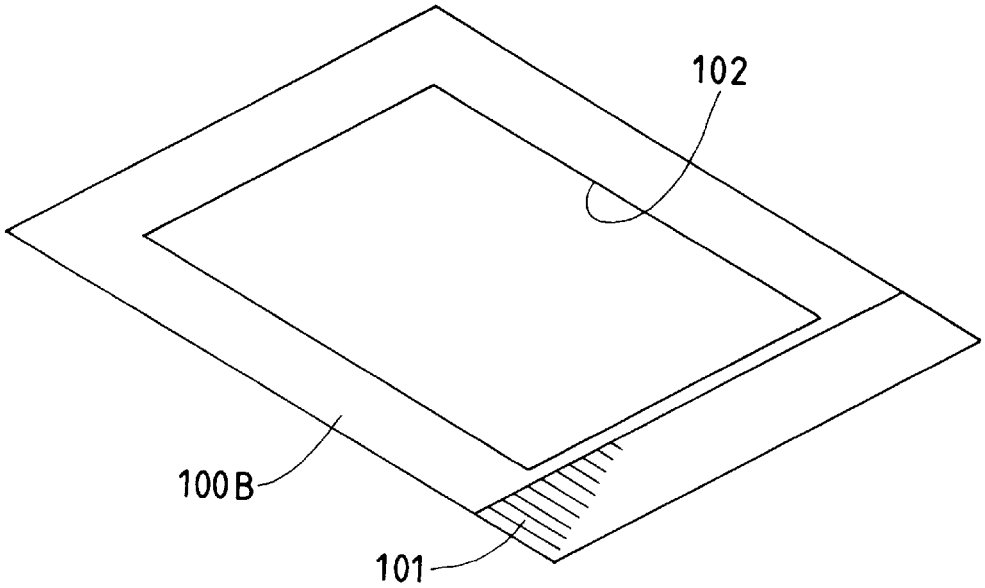
FIG. 26 is a perspective view of an absorb auxiliary sheet according to another embodiment.

Another absorb auxiliary sheet is shown in FIG. 26.

The absorb auxiliary sheet 100B has a large opening 102 formed at a position where the function as the absorb auxiliary sheet is not lost, so that the weight and air resistance of the absorb auxiliary sheet does not affect a bad influence upon the lifting of the absorb pads 51.

Figure 27:
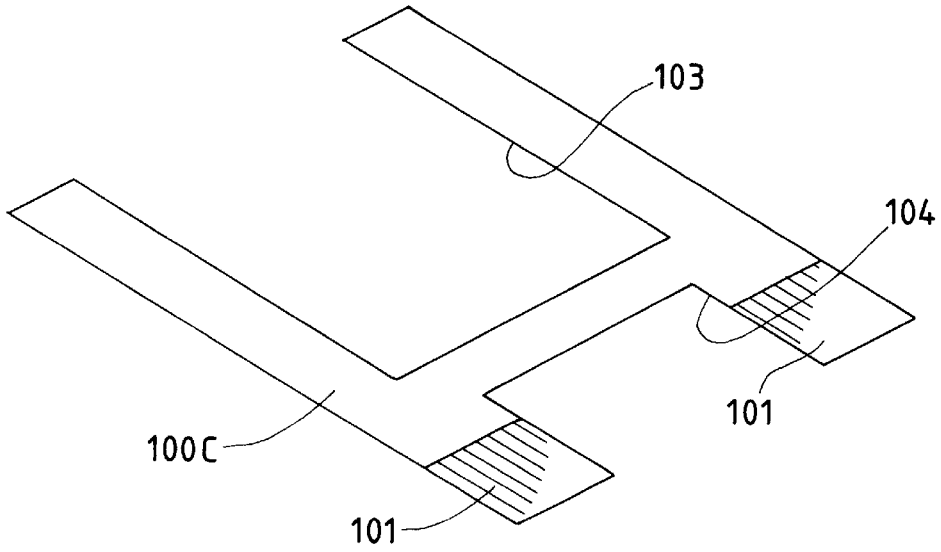
FIG. 27 is a perspective view of an absorb auxiliary sheet according to a further embodiment.

A further absorb auxiliary sheet is shown in FIG. 27.

The absorb auxiliary sheet 100C has the same purpose as the absorb auxiliary sheet 100B shown in FIG. 26. That is to say, by forming large notches 103, 104 in the absorb auxiliary sheet 100C, the sheet is cut out at the maximum within an allowable range that the function as the absorb auxiliary sheet is not lost.

Incidentally, while examples that the absorb auxiliary sheets 100A, 100B and 100C are formed from the PET sheets were explained, such absorb auxiliary sheets may be formed from synthetic resin sheets or metallic thin sheets. Further, an example that the low friction portions on the absorb auxiliary sheets 100A, 100B and 100C are formed from the Teflon layers were explained, in place of the Teflon layer, a synthetic resin layer made of supper polymer polyethylene or the like may be used. The absorb auxiliary sheets 100A, 100B and 100C may be secured to the lift/lower portion 2*b* of the sheet cassette 2 upstream thereof by any means other than the adhesive. For example, when these elements are pivotally connected via a hinge, the following ability of the absorb auxiliary sheet to the sheet P is improved considerably.

In place of the absorb auxiliary sheet for solving the problems caused by the sheet supplying apparatus of vacuum absorbing type, such problems can be solved by improving the cassette in the following manner.

Figure 28:
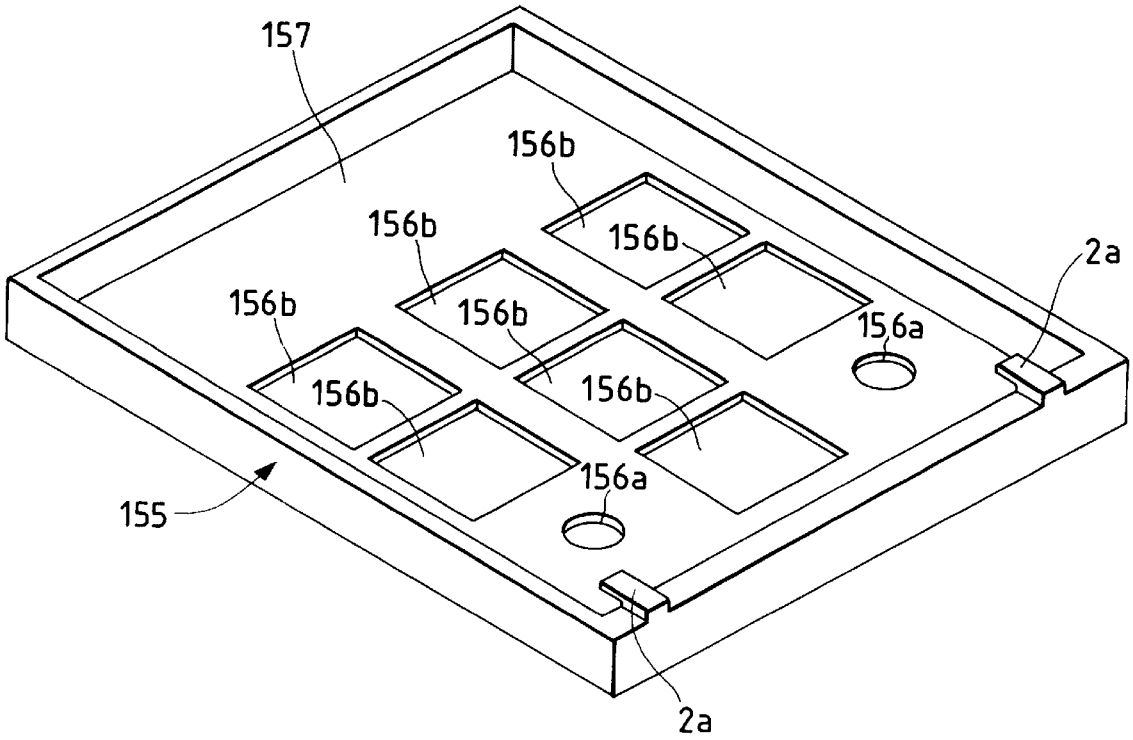
FIG. 28 is a perspective view of an improved cassette.

As shown in FIG. 28, an improved cassette 155 containing sheets P therein is provided at its bottom wall (157) with a plurality of holes 156*a*, 156*b*. Thus, air can freely flow between interior and exterior of the cassette 155 through holes 156*a*, 156*b*. However, the two holes 156*a* provided at positions corresponding to the absorb pads 51 have a size smaller than those of contact areas between the absorb pads 51 and the sheet P in consideration of the influence upon the absorbing action. The centers of the holes 156*a* are aligned with centers of the absorbed pads 51. Both holes 156*a* and 156*b* are referred to as merely "holes 156" hereinafter.

Next, a sheet supply operation using such a cassette 155 will be explained.

The sheet supplying operation will be described in orders (1) waiting, (2) absorption, (3) separation, and (4) feeding. Further, in this case, it is assumed that a small number of sheets having great permeability are stacked in the cassette 155.

Figure 29:
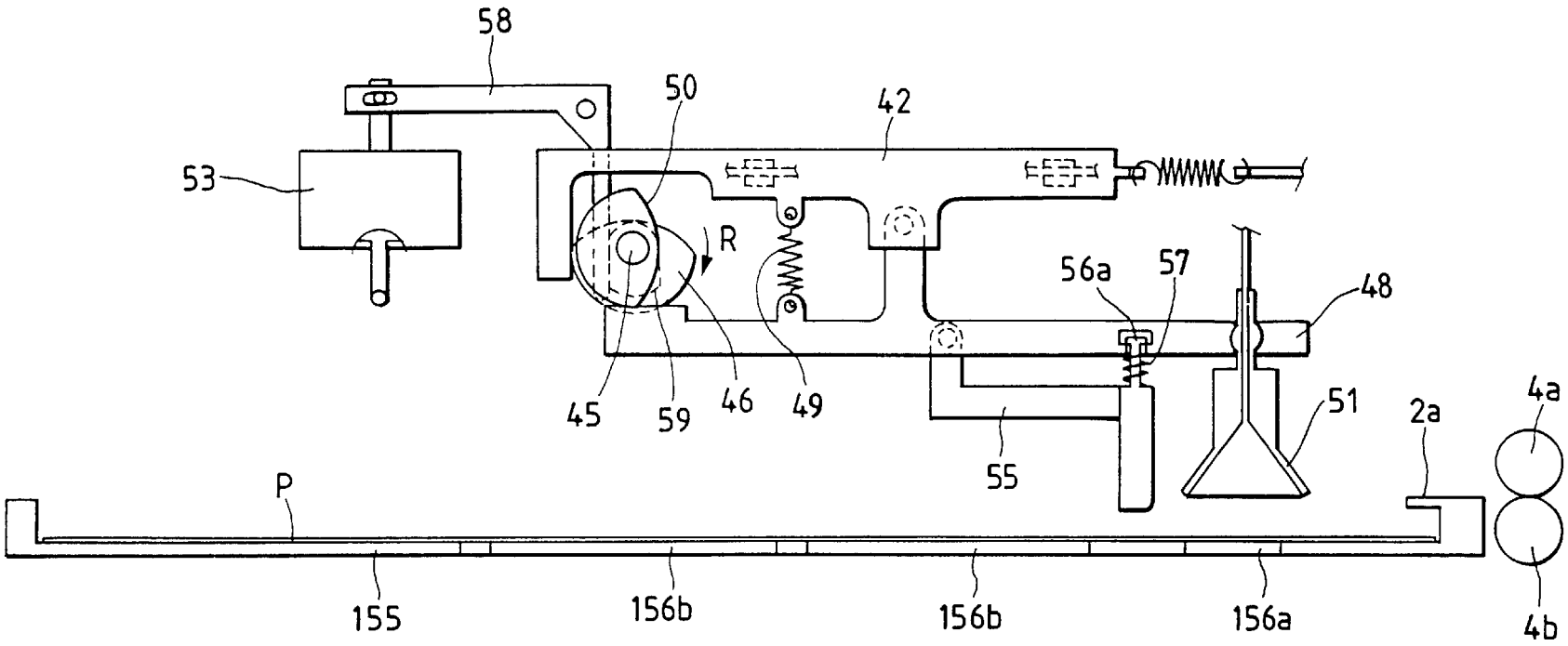
FIG. 29 is a sectional view of a sheet supplying apparatus having the cassette of FIG. 28.

(1) Waiting (refer to FIG. 29)

FIG. 29 shows a waiting condition before the sheet supplying operation is started. The high lift portions of the cams abut against the pivot arms 48 to maintain the pivot arms 48 substantially horizontally, and the absorb pads 51 are spaced apart from the sheet P. Further, the high lift portions of the cams 46 abut against the movable members 42 to maintain the movable arms in their left limit ends of strokes. The sheet stoppers 55 are biased downwardly by the compression springs 57 but are stopped by the stoppers 56*a* at the predetermined positions spaced apart from the sheet P. The low lift portion of the cam 59 abuts against the link 58, so that the movable rod of the suction pump 53 is not yet lifted. Thus, the negative pressure is not generated in the suction pump 53.

Figure 30:
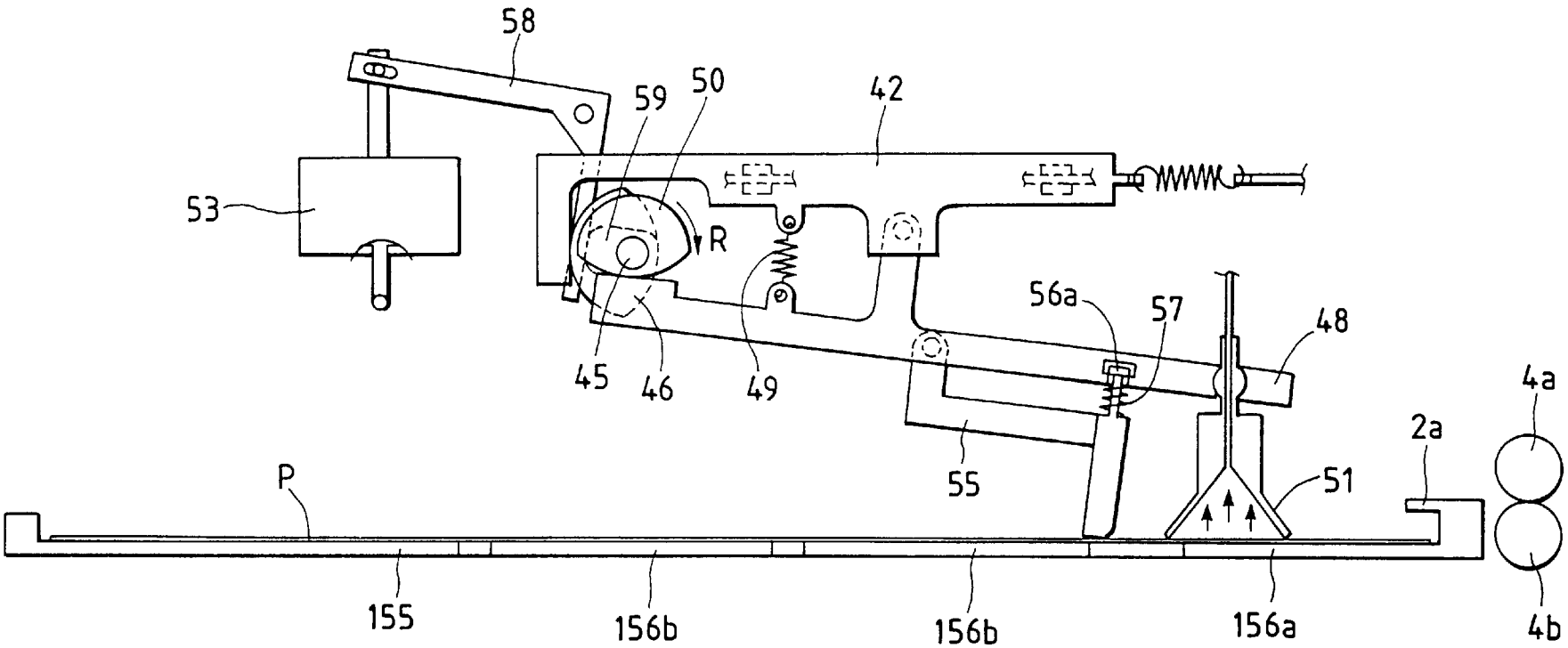
FIGS. 30, 31 and 32 are sectional views showing operating conditions of the sheet supplying apparatus.

(2) Absorption (refer to FIG. 30)

FIG. 30 shows a condition that the sheet P starts to be absorbed by the absorb pads 51. In this condition shown in FIG. 30, the cams 46, 50, 59 are rotated together with the rotation drive shaft 45 in the direction R from the condition shown in FIG. 29, so that the low lift portions of the cams 50 abut against the pivot arms 48 to lower the pivot arms 48, to thereby urge the absorb pads 51 against the sheet by the forces of the tension coil springs 49. In this case, since the holes 156*a* have the size smaller than those of contact areas between the absorb pads 51 and the sheet P, and the centers of the holes 156*a* are aligned with the centers of the absorb pads 51, the abutment between the absorb pads 51 and the sheet P does not become insufficient because of the presence of the holes 156*a*. In this case, the high lift portions of the cams 46 still abut against the movable members 42 to maintain the movable arms in their left limit ends of stroke. The sheet holders 55 are biased downwardly by the compression springs 57 to abut against the sheet stack P, to thereby regulate the sheet stack. The high lift portion of the cam 59 abuts against the link 58 to start to lift the link upwardly.

Then, the negative pressure is generated in the suction pump 53. In this case, since the air is introduced into the cassette 155 and the absorb pads 51 through the holes 156*a* to somewhat weaken the absorbing force of the absorb pads 51, even when the number of the remaining sheets is small, the absorb pads 51 do not adhere to the bottom of the cassette 155. As a result, the absorb pads 51 start to absorb the sheet P with proper negative pressure.

Figure 31:
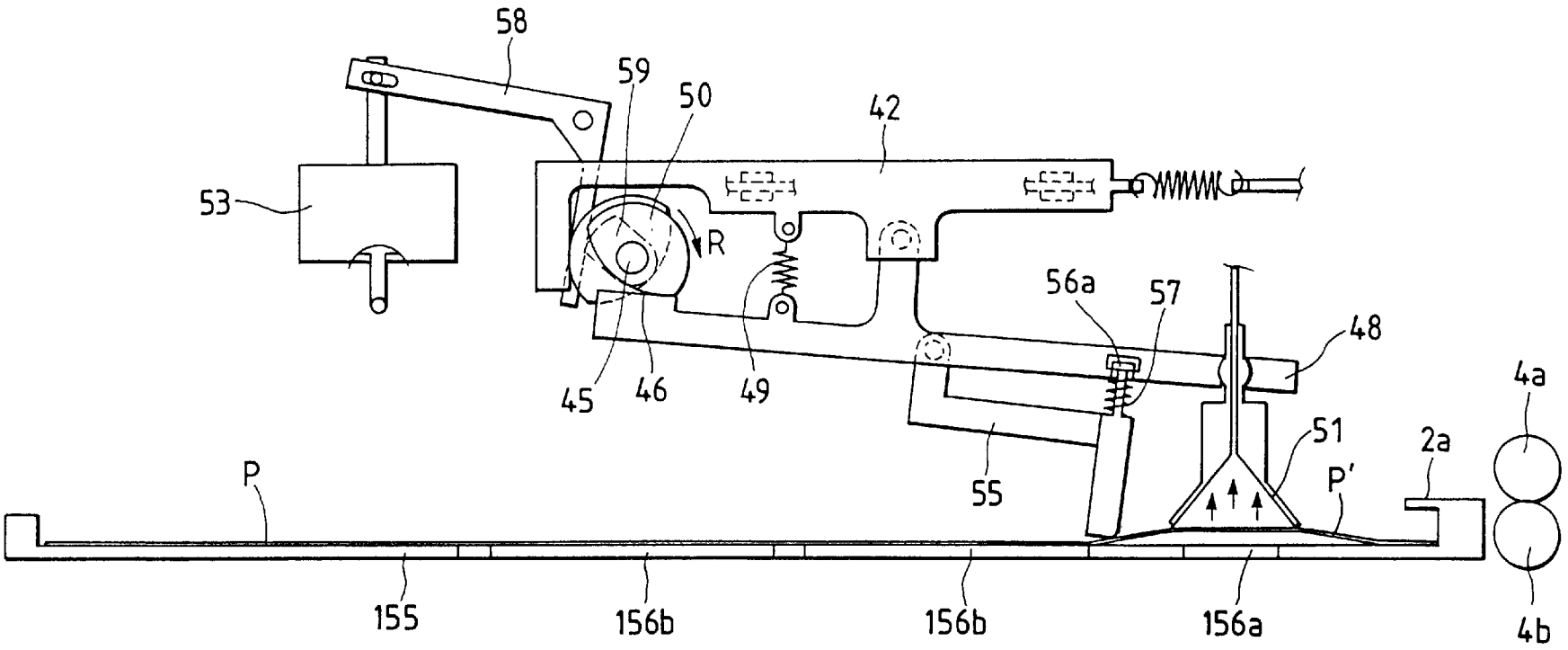

(3) Separation (refer to FIG. 31)

FIG. 31 shows a condition that the absorbed sheet P is separated. In this condition, the intermediate lift portions (between the high lift portions and the low lift portions) of the cams 50 abut against the pivot arms 48 to return it from the condition shown in FIG. 30 toward the horizontal condition more or less, so that the absorb pads 51 try to lift the sheet P'. The sheet holders 55 are biased downwardly by the compression springs 57 to still abut against the sheet stack P, to thereby regulate the sheet stack. Further, since the absorbing force to the second sheet is weaker than the absorbing force to the first sheet, the resiliency of the sheet portion between the separation pawls 2*a* and the sheet holders 55 overcomes the weaker absorbing force. Further, there is friction between the sheet holders 55 and the sheet. Thus, the first sheet can be separated from the other sheets P. Further, the high lift portions of the cams 46 still abut against the movable members 42 to maintain the movable arms in their left limit ends of strokes. The high lift portion of the cam 59 abuts against the link 58 to continue to lift the movable rod of the suction pump 53, so that the sheet P' is absorbed by the absorb pads 51.

Figure 32:
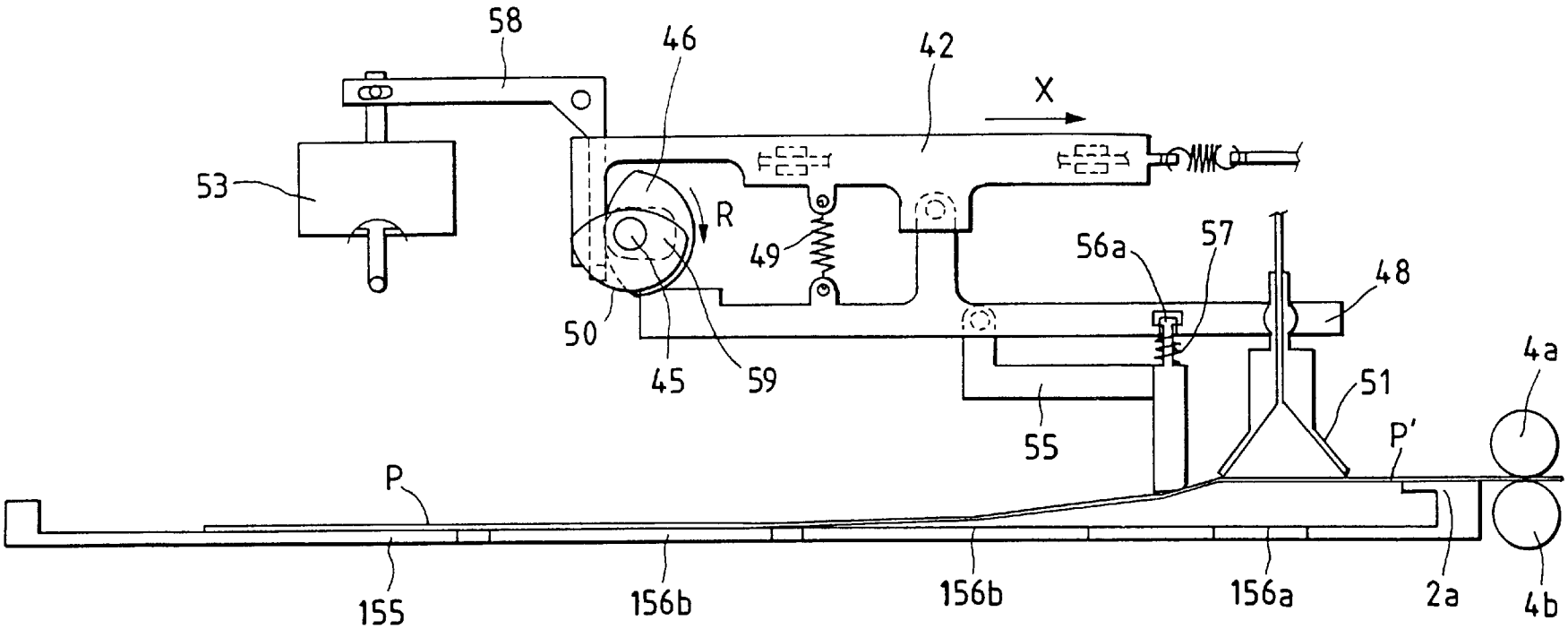

(4) Feeding (refer to FIG. 32)

FIG. 32 shows a condition that the absorbed sheet P' is fed toward the rollers 4*a*, 4*b*.

In this condition, the high lift portion of the cams 50 abut against the pivot arms 48 to return the pivot arms 48 in the horizontal condition, so that the absorb pads 51 lift the sheet P' up to a predetermined height. In this case, the sheet is shifted upwardly. As the sheet is shifted upwardly, a space between the sheet P' and the cassette 155 is gradually increased. In this case, in the illustrated embodiment, the air swiftly flows into the space through the holes 156. Thus, as the sheet is shifted upwardly, resistance is almost not generated.

The low lift portions of the cams 46 abut against the movable members 42 to shift the movable members in the direction X up to the predetermined position where the sheet P' is transferred to the pair of rollers 4*a*, 4*b*. Since the sheet stoppers 55 are held at the positions same as those shown in FIG. 29, although the sheet P' may be slightly contacted with the sheet stoppers, any urging force does not act on the sheet from the stoppers not to generate friction which would resist the feeding of the sheet. The low lift portion of the cam 59 again abuts against the link 58 to return the movable rod of the suction pump 53, to thereby stop the generation of negative pressure in the suction pump 53. Thus, after the sheet is transferred to the pair of rollers 4*a*, 4*b*, useless negative pressure is not generated in the absorb pads 51.

Figure 33:
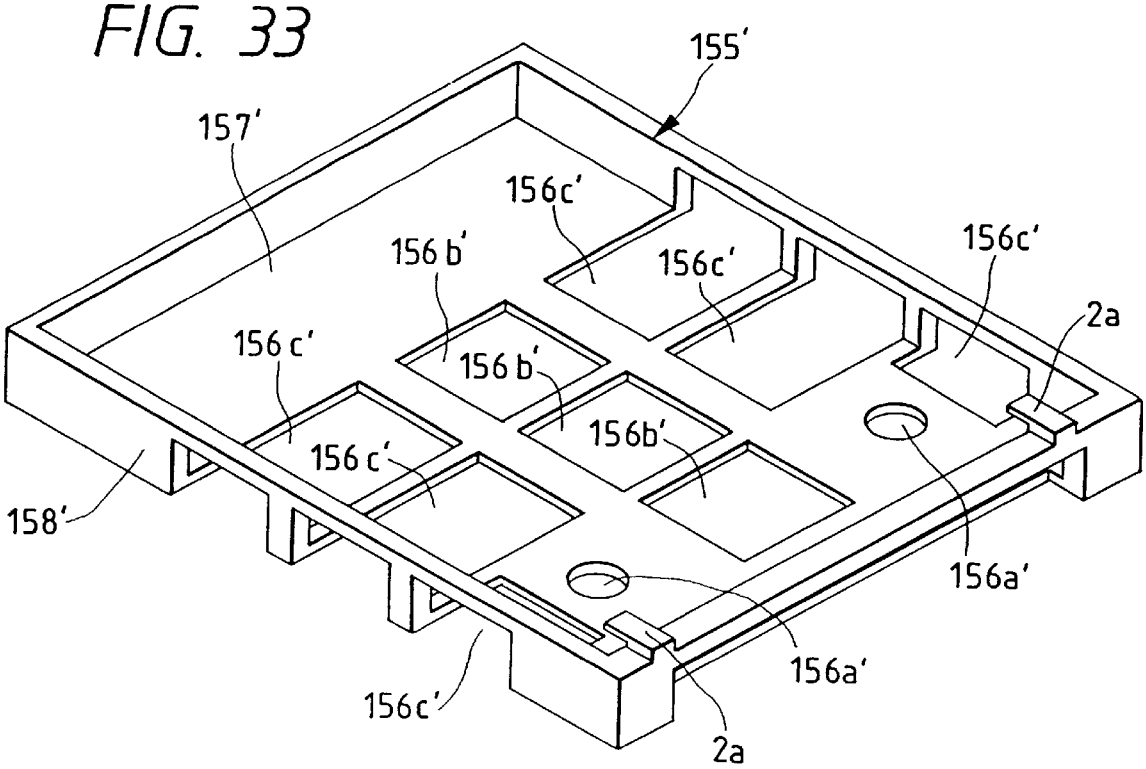
FIGS. 33 and 34 are perspective views showing other cassettes.

Next, another example of a cassette will be explained. A cassette 155' shown in FIG. 33 differs from the cassette 155 in configuration and position of holes 156. The cassette 155' is provided with a plurality of holes 156*a*', 156*b*' and 156*c*', cumulatively identified as 156', through which the air can easily flow. Among these holes, two holes 156*a*' formed in a bottom wall 157' of the cassette in correspondence to the absorb pads 51 have a size smaller than the contact areas between the absorb pads 51 and the sheet P. The centers of the holes 156*a*' are aligned with the centers of the absorb pads 51. Since holes 156*c*'formed in the cassette extend from the bottom wall 157'to side walls 158', the air can flow into the space between the sheet P and the cassette 155' more swiftly than the cassette 155. Thus, the resistance to the upward shifting of the sheet P is further reduced.

Figure 34:
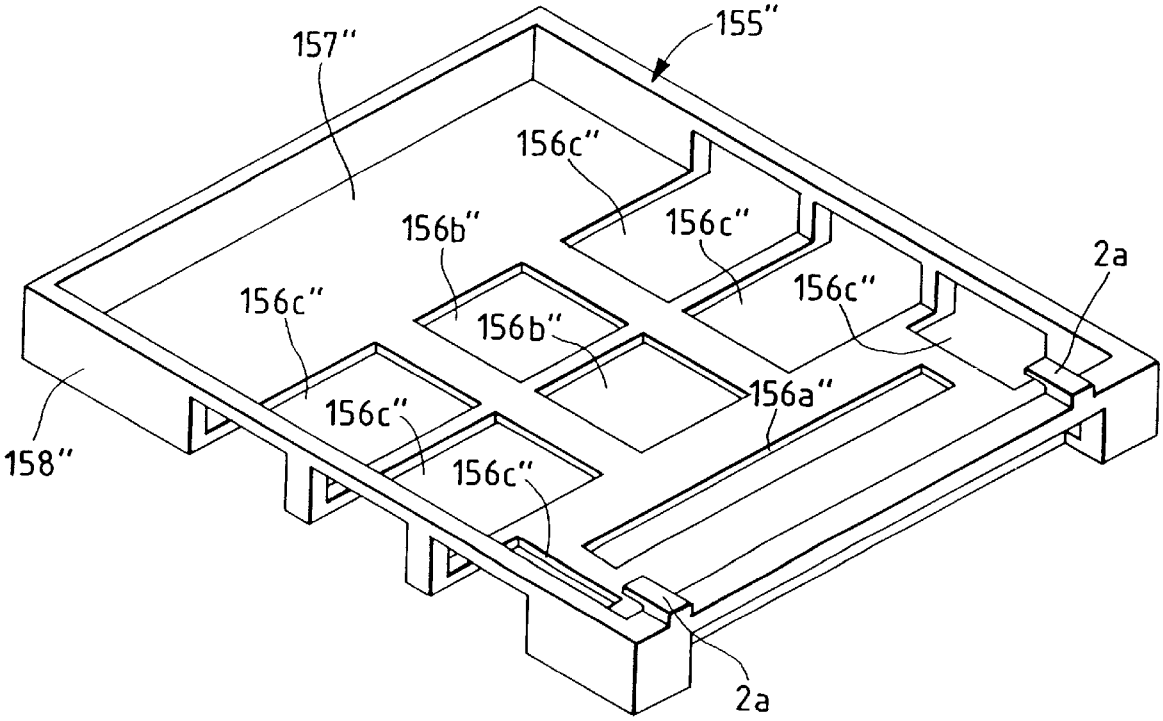

A further example of a cassette will be described. A cassette 155" shown in FIG. 34 differs from the cassette 155 in concrete configuration, particularly, in configuration and position of holes 156. The cassette 155" is provided with a plurality of holes 156*a*", 156*b*", and 156*c*", cumulatively identified as 156", through which the air can easily flow. Among these holes, a 156*a*" formed in a bottom wall 157" of the cassette in correspondence to the absorb pads 51 is an elongated rectangular hole having a width smaller than diameters of the contact area between the absorb pads 51 and the sheet P. Since holes 156*c*" formed in the cassette extend from the bottom wall 157" to side walls 158", the air can flow into the space between the sheet P and the cassette 155" more swiftly than the cassette 155. Thus, the resistance to the upward shifting of the sheet P is further reduced.

According to the aforementioned cassettes 155, 155' and 155", the air can flow into the cassette swiftly. Thus, a sheet supplying apparatus and an image forming apparatus which can handle a large size sheet and permit high speed sheet conveyance can be provided. Incidentally, the concrete configuration of the holes 156 formed in the cassettes are not limited to the above-mentioned examples. For example, the holes 156*a*, 156' and 156" corresponding to the absorb pads 51 may have star-like shapes or wheel spoke shapes. However, the holes preferably have the size smaller than the contact areas between the absorb pads 51 and the sheet P.

In the above examples, the holes 156 were formed in only by the bottom wall (or both bottom wall and side walls) of the cassette. However, the resistance to the upward shifting of the sheet is merely desired to be reduced, the holes may be formed in only side walls.

What is claimed is:

1. A sheet supplying apparatus comprising:

sheet supporting means for supporting sheets;

sheet absorbing means for absorbing a sheet from the sheets supported by said sheet supporting means by utilizing an absorbing force;

a suction pump for generating the absorbing force, wherein said suction pump has a pump container and a partition wall for changing an internal volume in the pump container, and wherein said partition wall is reciprocally shifted to generate negative pressure in the pump container;

shift means for shifting said sheet absorbing means toward a sheet supply means disposed downstream in a sheet supplying direction to send a sheet absorbed by said sheet absorbing means to said sheet supply means; and absorbing force adjusting means for adjusting the absorbing force to generate negative pressure in said suction pump so that negative pressure greater than a predetermined negative pressure is not generated in the suction pump.

2. A sheet supplying apparatus according to claim 1, wherein said sheet absorbing means and said shift means receive respective driving forces from a common drive source and said shift means is a link mechanism for supporting said sheet absorbing means and for shifting said sheet absorbing means between a position corresponding to an upper surface of the sheet and a position corresponding to said sheet supply mens.

3. A sheet supplying apparatus according to claim 2, further comprising a rotary shaft connected to said drive source to be rotated, wherein said partition wall of said suction pump is shifted by a first cam provided on said rotary shaft, and said link mechanism is operated by a second cam provided on said rotary shaft.

4. A sheet supplying apparatus according to claim 3, wherein a timing between the operation of said link mechanism and generation of negative pressure in said suction pump is appropriately set by difference in phase angle of said first and second cams provided on said rotary shaft.

5. A sheet supplying apparatus according to claim 2, wherein said link mechanism includes combined link members for shifting the sheet horizontally after lifting to bring the sheet to said sheet supply means.

6. A sheet supplying apparatus according to claim 1, further comprising a sheet holding means disposed upstream of said sheet absorbing means in the sheet supplying direction for holding down the sheet supported by said sheet supporting means.

7. A sheet supplying apparatus according to claim 6, wherein said sheet holding means is provided on said shift means so that, after said sheet absorbing means is shifted by said shift means to lift the sheet absorbed by said sheet absorbing means, said sheet holding means is shifted away from said sheet supporting means.

8. A sheet supplying apparatus according to claim 1, wherein said absorbing force adjusting means includes a first link member connected to said partition wall, a second link member connected to a drive source and an elastic member disposed between said first and second link members, so that the negative pressure generated in said suction pump is limited by adjusting a shifting amount of said partition wall by said elastic member, thereby adjusting the absorbing force of said sheet absorbing means.

9. A sheet supplying apparatus according to claim 1, wherein said absorbing force adjusting means is a valve for permitting communication between an interior of said suction pump and an atmosphere when the negative pressure generated in said suction pump exceeds a predetermined value.

10. A sheet supplying apparatus comprising:

sheet supporting means for supporting sheets;

sheet absorbing means for absorbing a sheet from the sheets supported by said sheet supporting means by utilizing an absorbing force;

a suction pump for generating the absorbing force, wherein said suction pump has a pump container and a partition wall for changing an internal volume in the pump container, and wherein said partition wall is reciprocally shifted to generate negative pressure in the pump container;

shift means for shifting said sheet absorbing means toward a sheet supply means disposed downstream in a sheet supplying direction to send a sheet absorbed by said sheet absorbing means to said sheet supply means; and absorb auxiliary means disposed on said sheet supporting means for reducing permeability of the sheet when the sheet is absorbed by said sheet absorbing means, wherein said absorb auxiliary means is a sheet-shaped member disposed in contact with a surface of the sheet opposite to a surface of the sheet absorbed by said sheet absorbing means.

11. A sheet supplying apparatus according to claim 10, wherein said absorb auxiliary means is secured to said sheet supporting means.

12. A sheet supplying apparatus comprising:

sheet supporting mens for supporting sheets;

sheet absorbing means for absorbing a sheet from the sheets supported by said sheet supporting means by utilizing an absorbing force;

a suction pump for generating the absorbing force, wherein said suction pump has a pump container and a partition wall for changing an internal volume in the pump container, and wherein said partition wall is reciprocally shifted to generate negative pressure in the pump container; and a shift means for shifting said sheet absorbing means toward a sheet supply means disposed downstream in a sheet supplying direction to send a sheet absorbed by said sheet absorbing means to said sheet supply means;

wherein said sheet supporting means has a bottom surface for supporting the sheets and a through hole is formed in said bottom surface, said through hole is situated at a position corresponding to an absorbing position where the sheet is absorbed by said sheet absorbing means.

13. An image forming apparatus comprising:

sheet supporting means for supporting sheets;

sheet absorbing means for absorbing a sheet from the sheets supported by said sheet supporting means by utilizing an absorbing force;

a suction pump for generating the absorbing force, wherein said suction pump has a pump container and a partition wall for changing an internal volume in the pump container, and wherein said partition wall is reciprocally shifted to generate negative pressure in the pump container;

shift means for shifting said sheet absorbing means toward a sheet supply means disposed downstream in a sheet supplying direction to send a sheet absorbed by said sheet absorbing means to said sheet supply means;

image forming means for forming an image on the sheet supplied by said sheet supply means; and absorbing force adjusting means for adjusting the absorbing force to generate negative pressure in said suction pump so that negative pressure greater than a predetermined negative pressure is not generated in the suction pump.

14. An image forming apparatus comprising:

sheet supporting means for supporting sheets;

sheet absorbing means for absorbing a sheet from the sheets supported by said sheet supporting means by utilizing an absorbing force;

a suction pump for generating the absorbing force, wherein said suction pump has a pump container and a partition wall for changing an internal volume in the pump container, and wherein said partition wall is reciprocally shifted to generate negative pressure in the pump container;

shift means for shifting said sheet absorbing means toward a sheet supply mean disposed downstream in a sheet supplying direction to send a sheet absorbed by said sheet absorbing means to said sheet supply means;

image forming means for forming an image on the sheet supplied by said sheet supply means; and absorb auxiliary means disposed on said sheet supporting means for reducing permeability of the sheet when the sheet is absorbed by said sheet absorbing means, wherein said absorb auxiliary means is a sheet-shaped member disposed in contact with a surface of the sheet opposite to a surface of the sheet absorbed by said sheet absorbing means.

15. An image forming apparatus comprising:

sheet supporting means for supporting sheets;

sheet absorbing means for absorbing a sheet from the sheets supported by said sheet supporting means by utilizing an absorbing force;

a suction pump for generating the absorbing force, wherein said suction pump has a pump container and a partition wall for changing an internal volume in the pump container, and wherein said partition wall is reciprocally shifted to generate negative pressure in the pump container;

shift means for shifting said sheet absorbing means toward a sheet supply means disposed downstream in a sheet supplying direction to send a sheet absorbed by said sheet absorbing means to said sheet supply means; and image forming means for forming an image on the sheet supplied by said sheet supply means;

wherein said sheet supporting means has a bottom surface for supporting the sheets and a through hole is formed in said bottom surface, said through hole is situated at a position corresponding to an absorbing position where the sheet is absorbed by said sheet absorbing means.

* * * * *

UNITED STATES PATENT AND TRADEMARK OFFICE

CERTIFICATE OF CORRECTION

PATENT NO. : 5,991,593

DATED : November 23, 1999

INVENTOR(S): HIROSHI SUGIYAMA

It is certified that error appears in the above-identified patent and that said Letters Patent is hereby corrected as shown below:

COVER PAGE AT ITEM [56] RC:
Foreign Patent Documents: Insert --61-023050 01/1986 Japan--.

COLUMN 7:
Line 4, "horizontally" should read --horizontal--.

COLUMN 9:
Line 4, "an" should read --a--; and
Line 29, "is" should read --are--.

COLUMN 13:
Line 2, "P"" should read --P" are--;
Line 3, "51" should read --51 and--; and
Line 25, "horizontally" should read --horizontal--.

COLUMN 15:
Line 41, "P'adhered" should read --P' adhered--; and
Line 51, "an" should read --a--.

COLUMN 16:
Line 62, "P'adhered" should read --P' adhered--.

UNITED STATES PATENT AND TRADEMARK OFFICE

CERTIFICATE OF CORRECTION

PATENT NO. : 5,991,593

DATED : November 23, 1999

INVENTOR(S): HIROSHI SUGIYAMA

It is certified that error appears in the above-identified patent and that said Letters Patent is hereby corrected as shown below:

COLUMN 17:
Line 8, "are" should read --is--;
Line 38, "has" should read --have--; and
Line 66, "to" should read --toward--.

COLUMN 19:
Line 19, "horizontally" should read --horizontal--.

COLUMN 20:
Line 52, "156c'formed" should read --156c' formed--; and
Line 53, "157'to" should read --157' to--.

COLUMN 21:
Line 50, "mens" should read --means--.

COLUMN 22:
Line 51, "mens" should read --means--.

UNITED STATES PATENT AND TRADEMARK OFFICE

CERTIFICATE OF CORRECTION

PATENT NO. : 5,991,593

DATED : November 23, 1999

INVENTOR(S): HIROSHI SUGIYAMA

It is certified that error appears in the above-identified patent and that said Letters Patent is hereby corrected as shown below:

COLUMN 23:

Line 41, 'mean" should read --means--.

Signed and Sealed this

Seventeenth Day of October, 2000

*Attest:*

Q. TODD DICKINSON

*Attesting Officer*

*Director of Patents and Trademarks*